US005753410A

United States Patent [19]

Goto et al.

[11] Patent Number: 5,753,410

[45] Date of Patent: May 19, 1998

[54] SILVER HALIDE PHOTOGRAPHIC LIGHT-SENSITIVE MATERIAL

[75] Inventors: Yoshitaka Goto; Takeo Arai, both of Hino, Japan

[73] Assignee: Konica Corporation, Japan

[21] Appl. No.: 689,845

[22] Filed: Aug. 15, 1996

Related U.S. Application Data

[63] Continuation of Ser. No. 425,387, Apr. 20, 1995, abandoned.

[30] Foreign Application Priority Data

Apr. 26, 1994 [JP] Japan ..... 6-088806

[51] Int. Cl.[6] ..... G03C 1/10

[52] U.S. Cl. ..... 430/264; 430/570

[58] Field of Search ..... 430/264, 570, 430/598, 945

[56] References Cited

U.S. PATENT DOCUMENTS

| | | | |
|---|---|---|---|
| 4,978,602 | 12/1990 | Fujita et al. | 430/264 |
| 4,988,603 | 1/1991 | Takamuki et al. | 430/264 |
| 4,994,345 | 2/1991 | Yoshizawa et al. | 430/264 |
| 5,004,669 | 4/1991 | Yamada et al. | 430/264 |
| 5,026,622 | 6/1991 | Yamada et al. | 430/264 |
| 5,085,970 | 2/1992 | Kameoka et al. | 430/264 |
| 5,098,820 | 3/1992 | McManus et al. | 430/517 |
| 5,200,298 | 4/1993 | Takagi et al. | 430/264 |
| 5,236,807 | 8/1993 | Inoue et al. | 430/264 |
| 5,238,800 | 8/1993 | Hosoi et al. | 430/496 |
| 5,296,343 | 3/1994 | Hioki et al. | 430/508 |
| 5,306,598 | 4/1994 | Kolosick | 430/264 |
| 5,340,694 | 8/1994 | Hioki et al. | 430/264 |
| 5,352,563 | 10/1994 | Kawasaki et al. | 430/264 |
| 5,366,845 | 11/1994 | Inoue et al. | 430/264 |
| 5,422,224 | 6/1995 | Katoh | 430/264 |
| 5,424,169 | 6/1995 | Ezoe et al. | 430/264 |
| 5,508,153 | 4/1996 | Ishikawa et al. | 430/445 |

OTHER PUBLICATIONS

Keller, Science and Technology of Photography, Chapter 2.2, pp. 13–25, 1993, Weinheim.

*Primary Examiner*—Hoa Van Le

*Attorney, Agent, or Firm*—Jordan B. Bierman; Bierman, Muserlian and Lucas

[57] ABSTRACT

Disclosed is a silver halide photographic light-sensitive material comprising a support having thereon a light-sensitive silver halide emulsion layer and a layer adjacent to said light-sensitive silver halide emulsion layer, wherein at least one of said layers contains a dye having a maximum absorption at a wavelength being within the range of ±50 nm of a maximum sensitivity wavelength of said light-sensitive silver halide emulsion layer, and at least one of said layers contains a hydrazine compound represented by the following Formula H:

Formula H

17 Claims, No Drawings

SILVER HALIDE PHOTOGRAPHIC LIGHT-SENSITIVE MATERIAL

This application is a continuation of application Ser. No. 08/425,387, filed Apr. 20, 1995, now abandoned.

FIELD OF THE INVENTION

The present invention relates to a silver halide photographic light-sensitive material for graphic arts use, particularly to a light-sensitive material for use with a laser scanner that emits a single wavelength light for exposure and to a method of forming an image by use of the light-sensitive material, and more particularly to a silver halide photographic light-sensitive material for graphic arts use that enables to form a high-contrast image and an image-forming method that uses the light-sensitive material.

BACKGROUND OF THE INVENTION

The photomechanical process includes a process to convert a continuous gradation original image into a halftone dot image. In this process, for reproducing a ultra-high contrast image, an infectious development technique has been used to date.

As a lith-type silver halide photographic light-sensitive material for use in infectious development there is generally used a silver chlorobromide emulsion comprising silver chlorobromide grains of which the average grain size is not more than about 0.2 μm, the silver chloride content of which is at least 50 mol%, and which are regular crystal grains having a narrow grain diameter distribution.

The above lith-type silver halide photographic light-sensitive material is processed in an alkaline hydroquinone developer solution having a low sulfite ion concentration, a so-called lith-type infectious developer solution, whereby a high-contrast and high-resolution image can be obtained.

The above-mentioned lith-type developer solution, however, has the disadvantage that the developer is subject to air oxidation, and when used in a continuous run of developing operations it is difficult keep its quality constant because of its bad preservability.

As a method for rapidly forming a high-contrast image without using the above developer solution, Japanese Patent Publication Open to Public Inspection (hereinafter abbreviated to JP O.P.I.) No. 106244/1981 discloses a method of developing a silver halide photographic light-sensitive material (herein-after sometimes called merely 'light-sensitive material') containing a hydrazine derivative. This method enables to easily and rapidly obtain a high-contrast image because of the good preservability of its developer solution. However, in this method, it was essential to use a developer solution having pH of 11.2 or above in order to let the hydrazine derivative sufficiently exhibit its capability to increase the image contrast formed by the light-sensitive material.

In a strong alkaline developer solution having pH of not lower than 11.2, when the developer is exposed to air, the oxidation of its developing agent becomes remarkable. Although it is stabler than the foregoing lith-type developer solution, the oxidation of the developing agent makes it sometimes unable to obtain any ultra-high-contrast image.

In order to eliminate the above shortcoming, JP O.P.I. Nos. 29751/1988, 179939/1989 and 179940/1989; and U.S. Pat. No. 4,975,354 disclose a photographic light-sensitive material containing a hydrazine derivative and a nuclear formation accelerator both of which enable the contrast increase even in a relatively low pH developer solution having pH of less than 11.2.

With the recent progress of the character/image integration in the electronic scanner system, there are increasing cases where a scanner output film is sent as the finalized film to the printing process. In this instance, the scanner film is required to have as much high a contrast halftone quality as conventional contact printing films.

On the other hand, there has been made practical reality and becomes popular in the market an image forming method, called 'FM screening,' which has a highly fine representation capacity to form an image with much finer halftone dots than conventional methods and to determine image pattern densities with various numbers of very small, fixed-size dots generated at random.

The above process of forming an image with halftone dots much smaller in size than those in conventional techniques has the problem that the halftone dot size tends to grow thicker than the ideal dot size (linearity) in an area where a halftone dot percentage (percentage of halftone dots accounting for of a unit area) changes largely to a specified amount of exposure, particularly where the percentage is approximately 50%.

From the above background, there has lately been developed a new light-sensitive material product, an improved scanner film into which is incorporated a technique to make its image contrast super-high by adding a tetrazolium salt or the above-mentioned hydrazine derivative thereto. However, the above light-sensitive material, although it can meet the quality requirement for halftone dot clear-cutness, is unable to sufficiently meet a screening process such as FM screening.

For example, in the aforementioned highly fine representation output, at a halftone dot percentage lower than a certain limit there arises the problem that halftone dots do not form at all, thus leading to narrowing the image-forming area. (Regarding this problem, the conventional rapid access-type light-sensitive material, although better in the apparent small dots reproducibility than a super-high-contrast light-sensitive material, actually does not show an adequate dot density, and thus does not work as halftone dots, so it is unacceptable.)

For this reason, if an increased amount of exposure is used to make a distinct representation of small halftone dots, there occurs the problem that middle-size halftone dots grow thicker, or large-size dots become defaced.

Because of the high contrast of the light-sensitive material, even if the exposure amount used is slightly lacking, the image density suddenly lowers, so that the light-sensitive material needs to be exposed to a light in a much higher quantity than necessary to give the maximum density. This matter also is a cause for growing middle-size halftone dots thicker, inviting the degradation of linearity. The dependence of the halftone dot percentage upon a quantity of light can not be remarkably improved even if the light-sensitive material's type is changed into a super-high contrast type.

In view of the above problem, European Patent No. 574078 discloses improvement of the linearity by providing a polymer-containing nonconductive hydrophilic colloid layer between the hydrazine derivative-contain emulsion layer and the support of a light-sensitive material.

The above improving method, however, is unable to improve the halftone dot's dependence on a quantity of light and the reproducibility of small halftone dots in a highly fine representation output.

JP O.P.I. No. 104046/1988 discloses the addition of a dye to the above technique to form a super-high-contrast image with use of a hydrazine derivative for the purpose of improving the safelight safety characteristic of the light-sensitive material handled in room light.

The light-sensitive material handled in room light is not exposed to a single-wavelength light; the addition of a dye is made for the purpose of more largely cutting off the wavelength region of a light source that is used as a safelight to thereby change the light-sensitive material's sensitivity balance between the light sources for exposure and for safelight, and not for the purpose of improving the photographic performance characteristics.

Further, it is well-known to improve the halftone dot enlarging characteristic of the light-sensitive material for camera exposure use by the addition of a dye that is capable of cutting off a specific short-wavelength light. However, this makes an attempt to improve the photographic performance by doing nothing but cutting off only a limited part of the broad wavelength region to which the light-sensitive material is sensitive. In the light-sensitive material to be exposed to a single wavelength light, the addition of a dye having no absorption in the wavelength region is meaningless because it provides no change in the resulting image quality and is not enough to improve the photographic performance of the light-sensitive material.

Thus, there has been a strong demand for improving the photographic performance of the light-sensitive material by raising the halftone dot's dependence on the quantity of light as well as the reproducibility of small halftone dots in the highly fine representation output.

SUMMARY OF THE INVENTION

It is an object of the invention to provide a light-sensitive material excellent in the clear-cut reproducibility of small halftone dots in the highly fine representation printing.

It is another object of the invention to provide a scanner light-sensitive material excellent in the reproducibility of small halftone dots and capable of forming halftone dots which are less growing fat.

It is still another object of the invention to provide a method for forming an image in accordance with FM screening process by using a scanner light-sensitive material excellent in the clear-cut reproducibility of small halftone dots in the highly fine representation printing and capable of forming halftone dots less growing fat.

The above objects of the invention are accomplished by the following items:

Item 1

A silver halide photographic light-sensitive material comprising a support having thereon a light-sensitive silver halide emulsion layer and a layer adjacent to said light-sensitive silver halide emulsion layer, wherein at least one of said layers contains a dye having a maximum absorption at a wavelength in a range of from a maximum sensitivity wavelength−50 nm to a maximum sensitivity wave-length+50 nm of said light-sensitive silver halide emulsion layer, and at least one of said layers contains a hydrazine compound represented by the following Formula H:

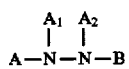

Formula H wherein A represents a substituted or unsubstituted alkyl group, an aryl group, a heterocyclic group; B represents an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfamoyl group, a sulfinamoyl group, an alkoxysulfonyl group, a thioacyl group, a thiocarbamoyl group, an acylcarbonyl group, a heterocyclic group; $A_1$ and $A_2$ independently represent a hydrogen atom, an acyl group, a sulfonyl group or an oxalyl group.

Item 2

The silver halide photographic light-sensitive material of item 1, wherein said hydrazine compound is represented by Formula Ha:

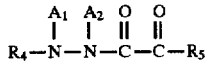

Formula Ha wherein $R_4$ represents an aryl group or a heterocyclic group, $R_5$ represents $—N(R_6R_7)$ group or $—OR_8$ group, wherein $R_6$ and $R_7$ independently represent a hydrogen atom, an alkyl group, an alkenyl group, an aryl group, a heterocyclic group, an amino group, a hydroxyl group, an alkoxyl group, an alkenyloxy group, an aryloxy group or a heterocyclicoxy group, provided that $R_6$ and $R_7$ may form a ring together with a nitrogen atom; $R_8$ represents a hydrogen atom, an alkyl group, an alkenyl group, an alkynyl group, an aryl group or a heterocyclic group; $A_1$ and $A_2$ are synonymous respectively with said $A_1$ group and said $A_2$ group represented by said Formula H.

Item 3

The silver halide photographic light-sensitive material of item 1, wherein said dye is contained in the form of a dispersion of solid particles dispersed in a hydrophilic binder.

Item 4

The silver halide photographic light-sensitive material of item 1, wherein said dye is incorporated by a process comprising the steps of:

(a) dispersing solid particles of said dye in a hydrophilic medium at a pH value of not more than 7 to form a solid particle dispersion; and (b) incorporating said dispersion in at least one of said layers.

Item 5

The silver halide photographic light-sensitive material of item 1, wherein said dye is contained in the form of said dispersion indicating a pH value of not more than 7.

Item 6

The silver halide photographic light-sensitive material of item 1, wherein said dye is contained in said light-sensitive layer.

Item 7

The silver halide photographic light-sensitive material of item 1, wherein said dye is contained in an amount of 0.001 to 0.3 in terms of an absorbance at said maximum absorption wavelength.

Item 8

The silver halide photographic light-sensitive material of item 1, wherein said dye is contained in an amount of 0.005 to 0.15 in terms of an absorbance at said maximum absorption wavelength.

Item 9

The silver halide photographic light-sensitive material of item 1, wherein said material is a silver halide photographic light-sensitive material for an argon laser use having said maximum sensitivity wavelength being within the range of 460 nm to 510 nm.

Item 10

The silver halide photographic light-sensitive material of item 1, wherein said material is a silver halide photographic light-sensitive material for a helium-neon laser use having said maximum sensitivity wavelength being within the range of 600 nm to 650 nm.

Item 11

The silver halide photographic light-sensitive material of item 1, wherein said material is a silver halide photographic light-sensitive material for a red diode laser use having said maximum sensitivity wavelength being within the range of 651 nm to 700 nm.

Item 12

The silver halide photographic light-sensitive material of item 1, wherein said material is a silver halide photographic light-sensitive material for infrared semiconductor laser used having said maximum sensitivity wavelength being within the range of 750 nm to 800 nm.

Item 13

The silver halide photographic light-sensitive material of item 1, wherein said hydrazine compound represented by Formula H is contained in an amount of $5\times10^{-7}$ to $5\times10^{-1}$ mol per mol of silver halide.

Item 14

The silver halide photographic light-sensitive material of item 1, wherein said hydrazine compound represented by Formula H is contained in an amount of $5\times10^{-6}$ to $5\times^{-2}$ mol per mol of silver halide.

Item 15

The silver halide photographic light-sensitive material of claim 1, wherein at least one of said layers comprises a compound represented by Formula Na or Formula Nb:

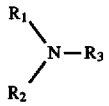

Formula Na wherein $R_1$, $R_2$ and $R_3$ each represent a hydrogen atom, an alkyl group, an alkenyl group, an alkynyl group or an aryl group, provided that $R_1$, $R_2$ and $R_3$ are not a hydrogen atom at the same time, and may combine to form a ring;

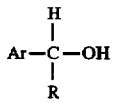

Formula Nb herein Ar represents an aryl group or a heterocyclic aromatic ring, and R represents an alkyl group, an alkenyl group, an alkynyl group or an aryl group

DETAILED DESCRIPTION OF THE INVENTION

The dye contained in the emulsion layer or a layer adjacent thereto on the light-sensitive silver halide emulsion layer side of the support is preferably a non-hydrophilic dye in the form of a solid dispersion under a pH condition of not more than 7. The dye-containing layer is preferably a light-sensitive silver halide emulsion layer and/or a layer adjacent to the emulsion layer. (The light-sensitive silver halide emulsion layer is hereinafter called merely 'the emulsion layer). Furthermore, the dye-containing layer is more preferably a light-sensitive silver halide emulsion layer.

Where these layers contain the dye, the dye may be present also in other layers. In order to improve the safelight safety of the light-sensitive material, they may contain a dye having a maximum absorption wavelength being not within the range of ±50 nm of a maximum sensitivity wavelength of the emulsion layer.

The invention remarkably exhibits its effect particularly in a scanner film to be exposed to a single-wavelength laser light. Examples of the laser light for use in exposure include argon laser, helium/neon laser, red semiconductor laser, infrared semiconductor laser, helium/cadmium laser, red LED, and various other blue-to-red laser lights.

The dye used in the present invention may be any dye as long as it has a maximum absorption wavelength within the limits of the emulsion layer's maximum sensitivity wavelength region ±50 nm, and in the case where the absorption wavelength of the dye is included in the wavelength range of the laser light to be used as the aforementioned light source, it gives further preferred results.

In the 'dye having a maximum absorption wavelength within ±50 nm of the emulsion layer's maximum sensitivity wavelength.' the maximum sensitivity wavelength implies a wavelength that is defined as the wavelength giving the maximum sensitivity when the light-sensitive material of the invention is exposed to a spectral light, while the maximum absorption wavelength implies a wavelength at which the spectral absorption value of the dye becomes maximum and is defined by the absorption wavelength of the dye that is dispersed into a binder to be made in the form of a film. Where there is no maximum absorption wavelength within the ±50 nm limits, there can not be found any small halftone dots reproducibility improving effect of the invention.

The hydrophilicity or nonhydrophilicity of the dye used in the invention are defined as follows:

The nonhydrophilic dye of the invention is defined to be a dye having a solubility of not more than 0.1% by weight in water at 250° C. and pH 7, whereas the hydrophilic dye of the invention is a dye having a solubility of exceeding 0.1% by weight in water at 25° C. and pH7.

The dye of the invention is explained in detail.

Among the dyes of the invention, examples of those suitable for the light-sensitive material for argon laser use having a spectral sensitivity λmax of around 488 nm are shown below, but the invention is not limited thereto.

(I-1)
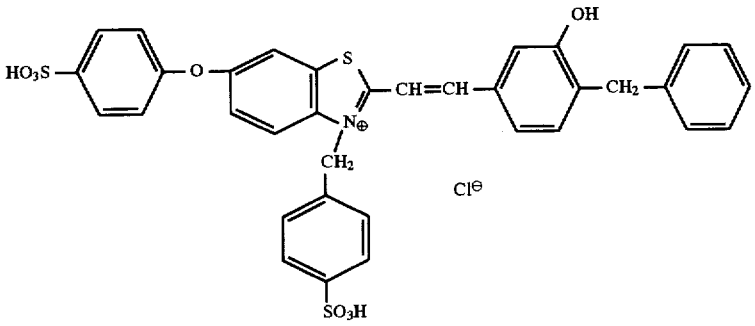
(I-2)
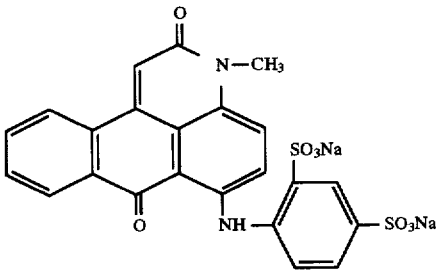
(I-3)
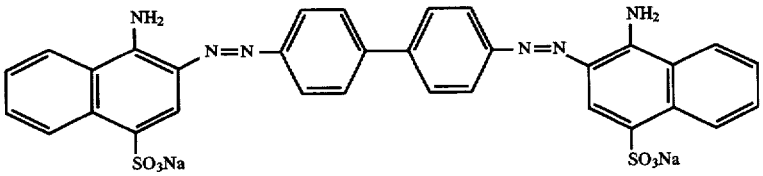
(I-4)
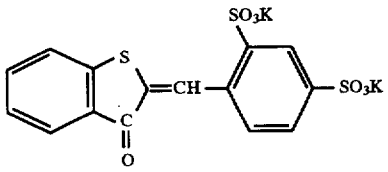
(I-5)
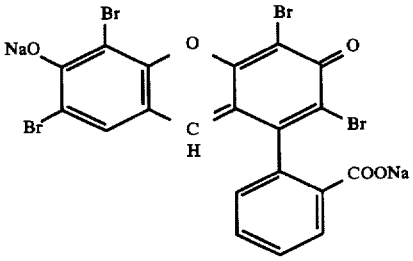
(I-6)
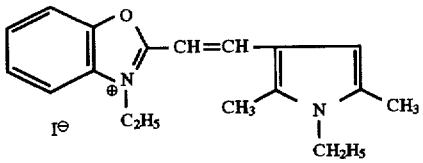
(I-7)
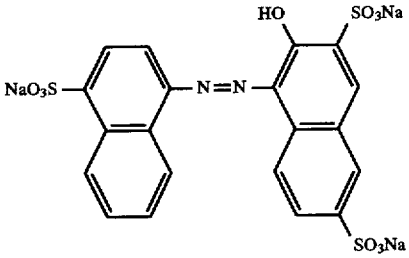

-continued
(I-8)
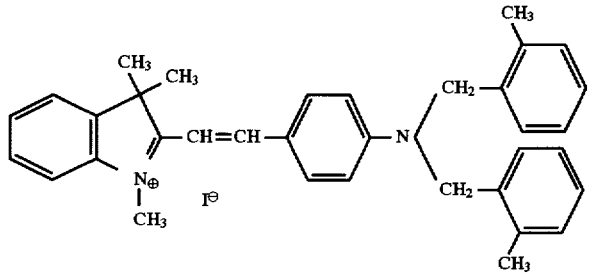
(I-9)
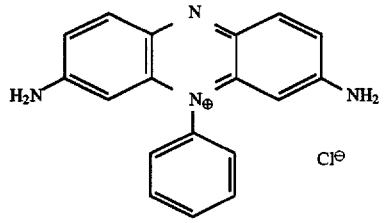
(I-10)
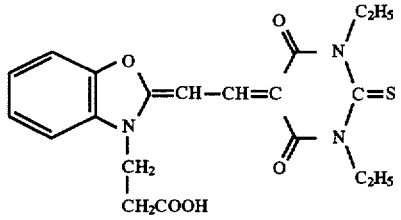
(I-11)
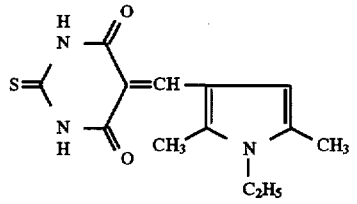
(I-12)
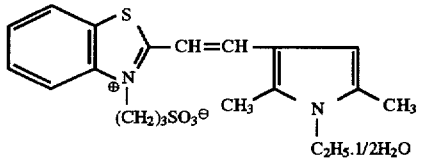
(I-13)
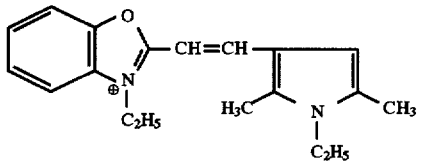
(I-14)
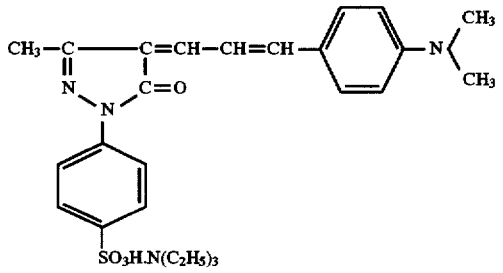

-continued
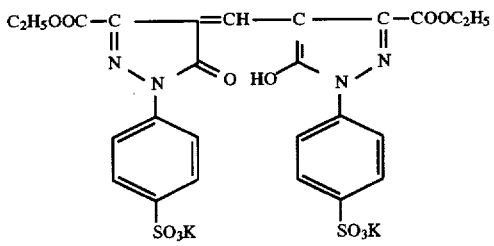
(I-15)
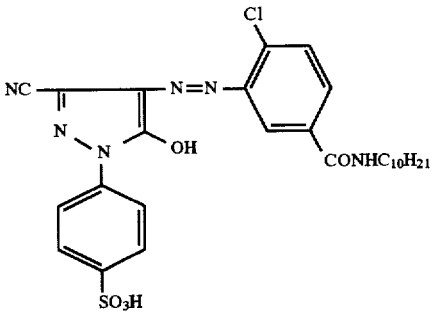
(I-16)
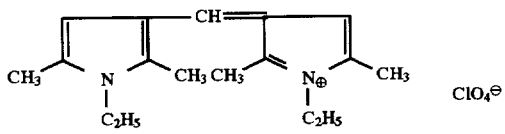
(I-17)
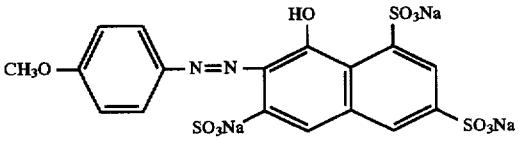
(I-18)
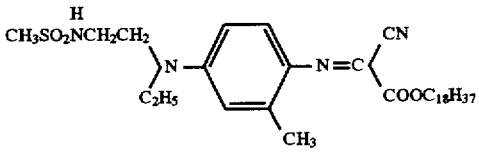
(I-19)
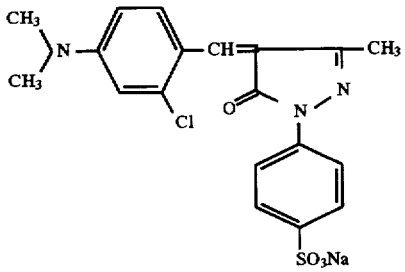
(I-20)
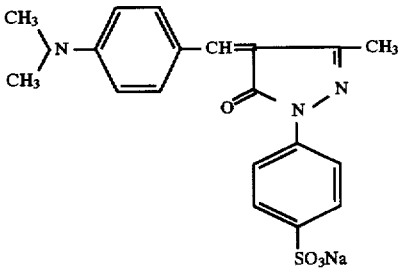
(I-21)

-continued
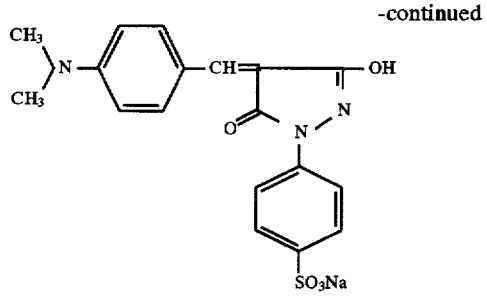
(I-22)
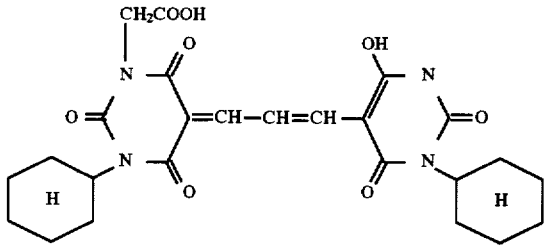
(I-23)
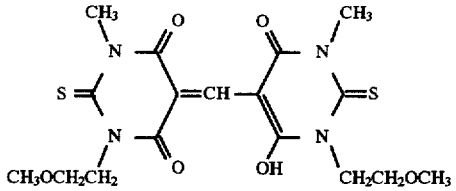
(I-24)
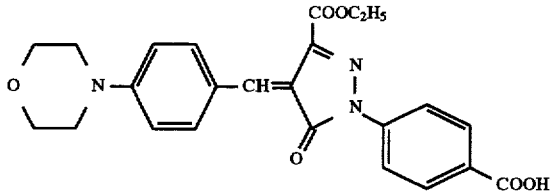
(I-25)
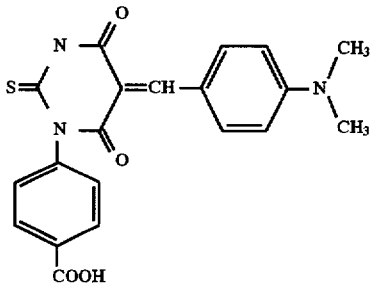
(I-26)
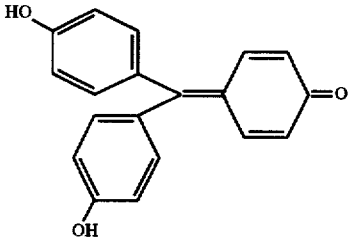
(I-27)
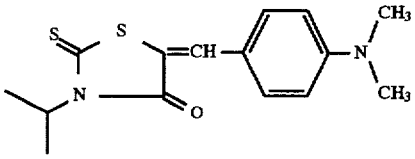
(I-28)

Among the dyes of the invention, examples of those suitable for the light-sensitive material for helium/neon laser use having a spectral sensitivity λmax of around 633 nm are given below, but the invention is not limited thereto.
(II-1)
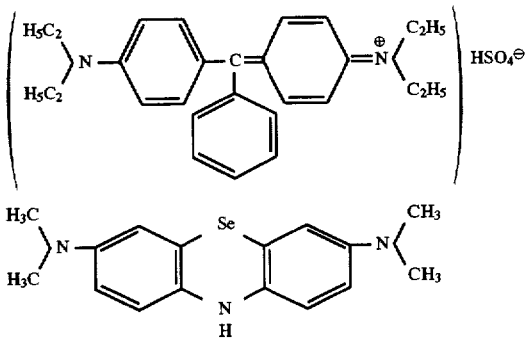
(II-2)
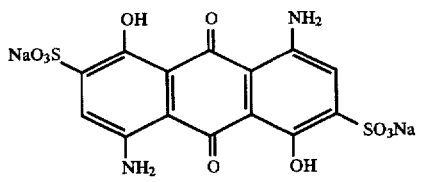
(II-3)
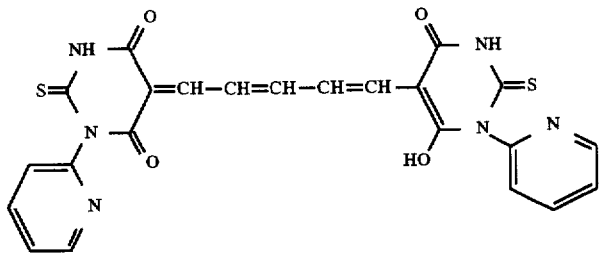
(II-4)
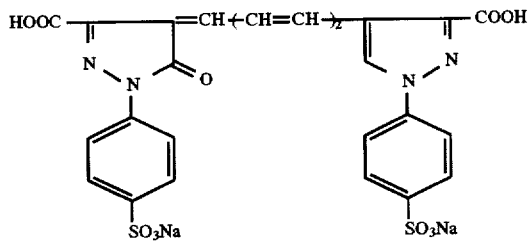
(II-5)
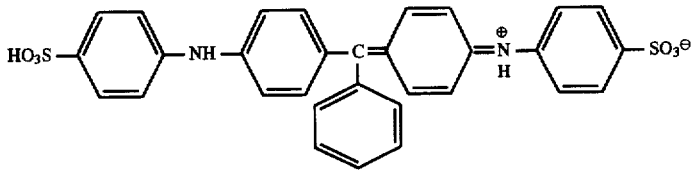
(II-6)
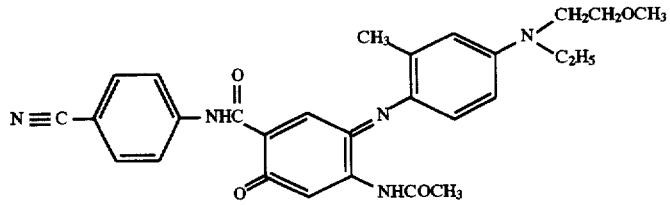
(II-7)
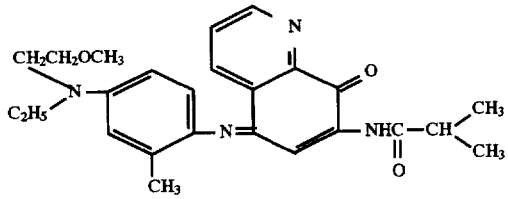

-continued
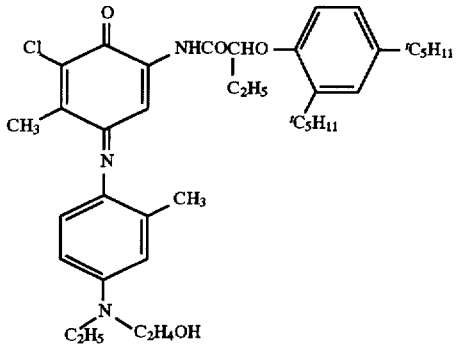
(II-8)
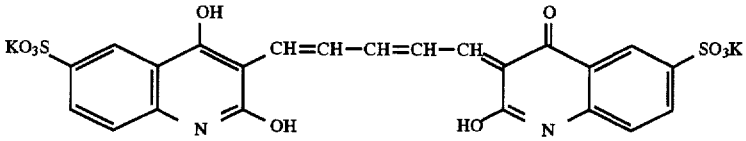
(II-9)
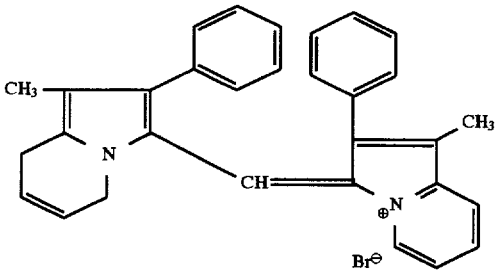
(II-10)
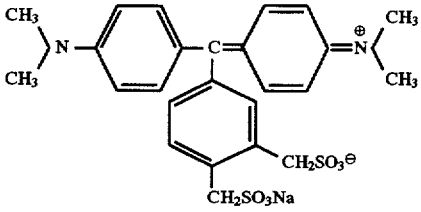
(II-11)
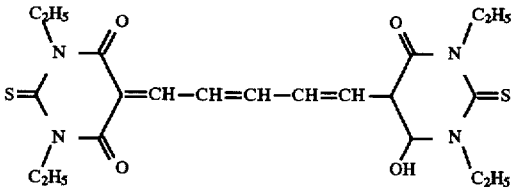
(II-12)
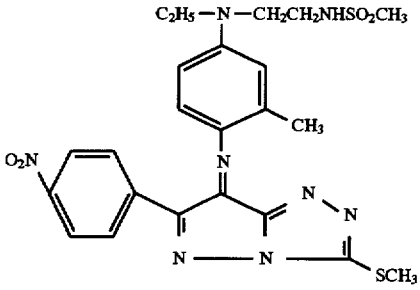
(II-13)

-continued
(II-14)
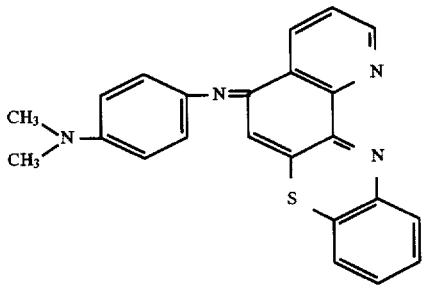
(II-15)
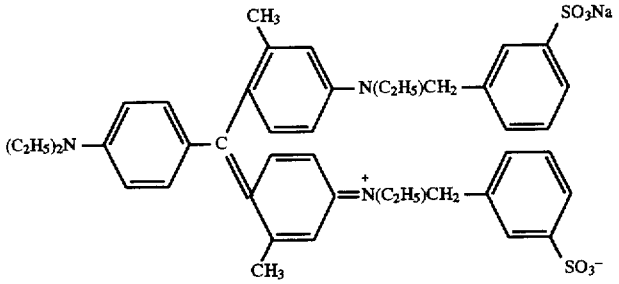
(II-16)
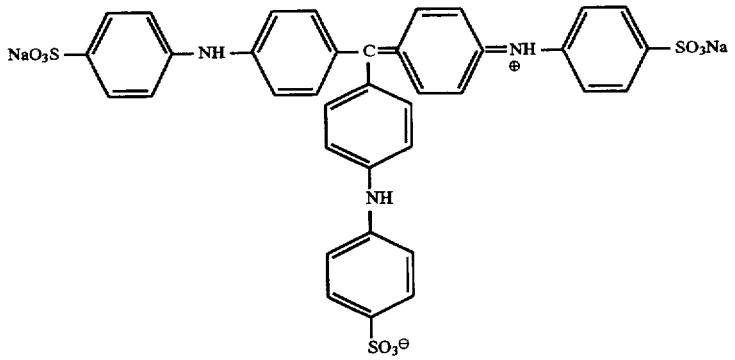
(II-17)
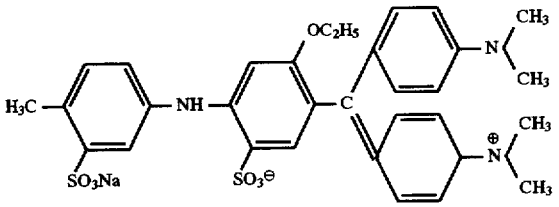
(II-18)
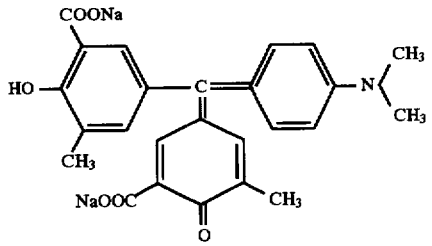
(II-19)
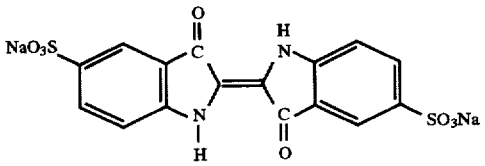

-continued

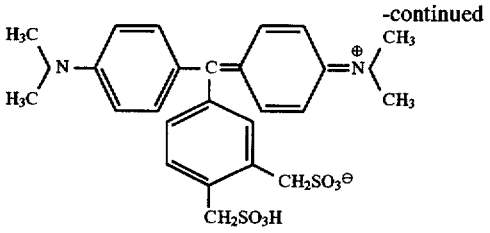

(II-20)

Among the dyes of the invention, examples of those suitable for the light-sensitive material for red laser diode use having a spectral sensitivity λmax of around 670 nm are given below, but the invention is not limited thereto.

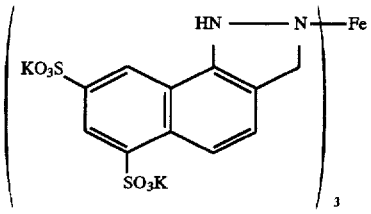

(III-1)

-continued

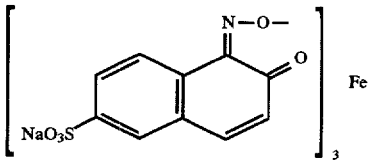

(III-2)

Among the dyes of the invention, examples of those suitable for the light-sensitive material for infrared semiconductor laser use having a spectral sensitivity λmax of around 780 nm are given below, but the invention is not limited thereto.

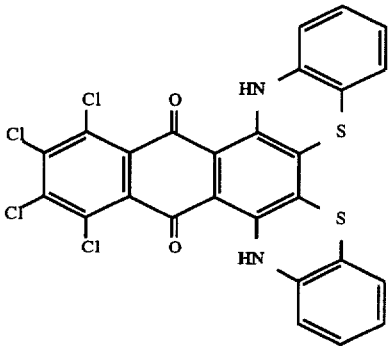

(IV-1)

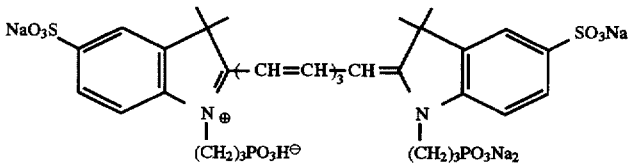

(IV-2)

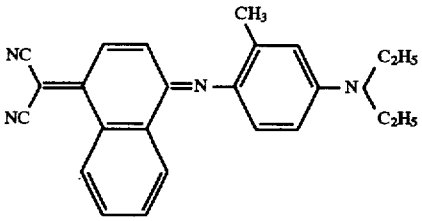

(IV-3)

-continued (IV-4)

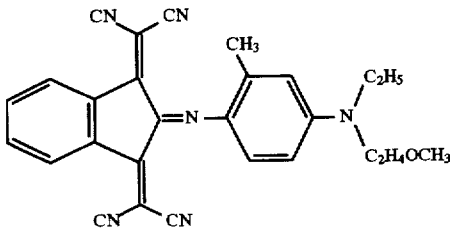

(IV-5)

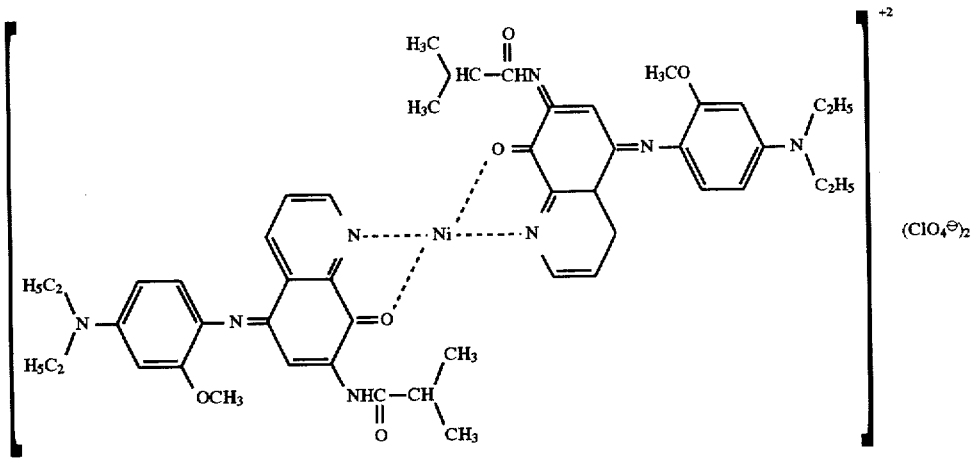

(IV-6)

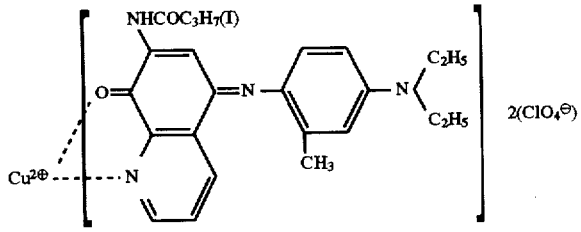

(IV-7)

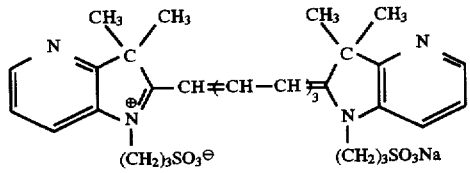

In the invention, providing at least one hydrophilic colloid layer between the emulsion layer and the support makes it possible to obtain advantageous effects such as excellent reproducibility of small halftone dots which little grow thick, and the like. The most preferred as the binder for the hydrophilic colloid layer to be provided between the emulsion layer and the support is gelatin, but other materials may also be used which include gelatin derivatives and other hydrophilic polymers. The amount of the binder used is preferably 0.1 to 3.0 g/m$^2$, and most preferably 0.2 to 2.0 g/m$^2$.

The above hydrophilic colloid layer may also contain various compounds generally used for photographic light-sensitive materials, which include surfactant for improving coatability, diffusible or nondiffusible dye, hardener, polymer latex, water-soluble polymer, development accelerator, development inhibitor, photographically useful group-releasing precursor, solid particles such as colloidal silica, developing agent, and the like.

The support used in the invention may have on its surface a subbing layer for improving the adhesion of the surface to a hydrophilic colloid layer, and the subbing layer may contain various additives such as a conductive compound, a dye, and the like.

The light-sensitive material of the invention can exhibit an excellent effect particularly in the image forming method according to FM screening process.

The FM screening process is a method in which fine particles of a fixed size are generated at random, and an imagewise pattern is rendered by different number of such particles in unit area, not by different dot sizes. This principle was introduced by R. L. Hallows, Jr. and R. J. Klench (1962), but it has lately been made practical reality and is now prevailing in the market with softwares such as Diamond Screen, produced by Linotypehell Corp., Crystal Raster by Agfa Gevaert, and Fulltone Screen by Scitex, which is similar to FM screening.

According to the above method, the Rosetta pattern that has conventionally been recognized is eliminated, and an image which is equal in the quality to or more than conventional ones can be obtained even when the number of dots per inch in length is less than conventional dots. However, this process has the problem that the degree of changes in the approximately 50% dot area becomes extremely conspicuous; this phenomenone becomes more intensified particularly as the dot size gets smaller to raise image resolution, so that it is substantially impossible to make the image formation stable, which has so far been a stumbling block to image quality improvement.

The light-sensitive material of the invention is very suitable for use in the FM screening process because it is capable of forming clear-cut small dots as well as of forming large dots that are hardly defaced and also because the dependence of the dot area upon exposure amount is so small that a high-resolution FM screen image can be stably obtained.

The combination of the light-sensitive material of the invention with the FM screening process makes it possible to provide the most excellent-ever image forming method.

The hydrazine derivative in the invention needs to be contained in at least one of arbitrary hydrophilic colloid layers which are present on the silver halide emulsion-containing side of the support, and may be contained in two or more different layers, more particularly in the silver halide emulsion layer and/or at least one of hydrophilic colloid layers adjacent to the silver halide emulsion layer.

The preferred as the hydrazine derivative used in the invention is a compound represented by the following Formula H.

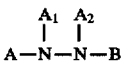

Formula H wherein A represents an aliphatic group preferably having 1 to 30 carbon atoms, and more preferably a straight-chain alkyl group having 1 to 20 carbon atoms or a branched-chain cycloalkyl group, such as a methyl group, an ethyl group, a t-butyl group, an octyl group, a cyclohexyl group or a benzyl group; each of these groups may further have a substituent such as an aryl, alkoxy, aryloxy, alkylthio, arylthio, sulfoxy, sulfonamido, acylamino or ureido group.

In Formula H, the aromatic group represented by A is preferably a single or condensed cyclic aryl group, such as benzene or naphthalene ring.

In Formula H, the heterocyclic group represented by A is preferably a single or condensed heterocyclic group containing at least one hetero atom selected from the class consisting of nitrogen, sulfur and oxygen atoms, such as a pyrrolidine ring, imidazole ring, tetrahydrofuran ring, morpholine ring, pyridine ring, pyrimidine ring, quinoline ring, thiazole ring, benzothiazole ring, thiophene ring or furan ring.

The most preferred as A are an aryl group and a heterocyclic group.

The aryl group and the heterocyclic group represented by A may each have a substituent. Typical examples of the substituent include an alkyl group having preferably 1 to 20 carbon atoms; an aralkyl group whose alkyl moiety is a single or condensed ring having preferably 1 to 3 carbon atoms; an alkoxy group whose alkyl moiety has preferably 1 to 20 carbon atoms; a substituted amino group which is preferably an amino group substituted by an alkyl or alkylidene group having 1 to 20 carbon atoms; an acylamino group having preferably 1 to 40 carbon atoms; a sulfonamido group having preferably 1 to 40 carbon atoms; a ureido group having preferably 1 to 40 carbon atoms; a hydrazinocarbonylamino group having preferable 1 to 40 carbon atoms; a hydroxyl group; and a phosphoamido group having preferably 1 to 40 carbon atoms.

The group represented by A preferably contains at least one nondiffusible group or silver halide adsorption accelerating group. The nondiffusible group is preferably a ballast group that is usually used in an immobile photographic additive such as a coupler, etc., wherein the ballast group is a photographically relatively inactive group having 8 or more carbon atoms, such as an alkyl, alkenyl, alkynyl, alkoxy, substituted phenyl, substituted phenoxy or alkylphenoxy group.

The silver halide adsorption accelerating group is a thiourea group, thiourethane group, mercapto group, thioether group, thione group, heterocyclic group, thioamido heterocyclic group, mercapto heterocyclic group or the adsorption group described in JP O.P.I. No. 90439/1989.

In Formula H, B represents an acyl group such as formyl, acetyl, propionyl, trifluoroacetyl, methoxyacetyl, phenoxyacetyl, methylthioacetyl, chloroacetyl, benzoyl, 2-hydroxymethylbenzoyl or 4-chlorobenzoyl; an alkylsulfonyl group such as methanesulfonyl or 2-chloroethanesulfonyl; an arylsulfonyl group such as benzenesulfonyl; an alkylsulfinyl group such as methanesulfinyl; an arylsulfinyl group such as benzenesulfinyl; a carbamoyl group such as methylcarbamoyl or phenylcarbamoyl; an alkoxycarbonyl group such as methoxycarbonyl or methoxyethoxycarbonyl; an aryloxycarbonyl group such as phenoxycarbonyl; a sulfamoyl group such as dimethylsulfamoyl; a sulfinamoyl group such as methylsulfinamoyl; an alkoxysulfonyl group such as methoxysulfonyl; a thioacyl group such as methylthiocarbonyl; thiocarbamoyl group such as methylthiocarbamoyl; an oxalyl group; or a heterocyclic group such as pyridine or pyridinium.

In Formula H, B may, together with $A^2$ and with the nitrogen atom combining to it, form

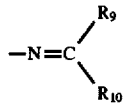

wherein $R_9$ represents an alkyl group, an aryl group or a heterocyclic group, and $R_{10}$ represents a hydrogen atom, an alkyl group, an aryl group or a heterocyclic group.

The most preferred as B is an acyl group or an oxalyl group.

$A_1$ and $A_2$ each represent a hydrogen atom, or either one of them is a hydrogen atom and the other is an acyl group such as acetyl, trifluoroacetyl or benzoyl; a sulfonyl group such as methanesulfonyl or toluenesulfonyl; or an acylcarbonyl group such as ethoxalyl group.

The particularly preferred among the hydrazine compounds applicable to the invention is a compound represented by the following Formula Ha.

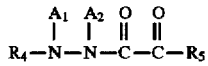

wherein $R_4$ represents an aryl group or a heterocyclic group;

$R_5$ represents

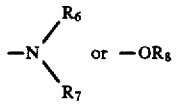

wherein $R_6$ and $R_7$ each represent a hydrogen atom, an alkyl group, an alkenyl group, an alkynyl group, an aryl group, a heterocyclic group, an amino group, a hydroxyl group, an alkoxy group, an alkenyl group, an oxy group, an alkynyloxy group, an aryloxy group or a heterocylooxy group, provided that $R_6$ and $R_7$ may form a ring together with the nitrogen atom; $R_8$ represents a hydrogen atom, an alkyl group, an alkenyl group, an alkynyl group, an aryl group or a heterocyclic group. $A_1$ and $A_2$ are as defined in the foregoing Formula H.

Formula Ha is further explained in detail.

The aryl group represented by $R_4$ is preferably a group of single or condensed ring such as benzene or naphthalene ring.

The heterocyclic group represented by $R_4$ is preferably a 5- or 6-member unsaturated heterocyclic group containing at least one hetero atom selected from- the class consisting of nitrogen, sulfur and oxygen atoms, such as group having a pyridine ring, quinoline ring, pyrimidine ring, thiophene ring, furan ring, thiazole ring or benzothiazole ring.

The preferred as $R_4$ is a substituted or unsubstituted aryl group, wherein the substituent is as defined for the substituent to A of Formula H. The aryl group, where contrast increase is made in a developer solution whose pH is 11.2 or lower, preferably has at least one sulfonamido group as a substituent.

$A_1$ and $A_2$ each represent the same group as defined for the $A_1$ and $A_2$ of Formula H, but most preferably each represent a hydrogen atom.

$R_4$ represents

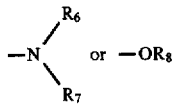

wherein $R_6$ and $R_7$ each represent a hydrogen atom, an alkyl group such as methyl, ethyl or benzyl; an alkenyl group such as allyl or butenyl; an alkynyl group such as propargyl or butynyl; an aryl group such as phenyl or naphthyl; a heterocyclic group such as 2,2,6,6-tetramethylpiperidyl, N-benzylpiperidinyl, quinolidinyl, N,N-diethylpyrazolidinyl, N-benzylpyrrolidinyl or pyridyl; an amino group such as amino, methylamino, dimethylamino or dibenzylamino; a hydroxyl group; an alkoxy group such as methoxy or ethoxy; an alkenyloxy group such as allyloxy; an alkynyloxy group such as propargyloxy; an aryloxy group such as phenoxy; or a heterocyclic oxy group such as pyridyloxy, provided that $R_6$ and $R_7$ may combine with the nitrogen atom to form a ring such as piperidine or morpholine. $R_8$ represents a hydrogen atom, an alkyl group such as methyl, ethyl, methoxyethyl or hydroxyethyl; an alkenyl group such as allyl or butenyl; an alkynyl group such as propargyl or butynyl; an aryl group such as phenyl or naphthyl; or a heterocyclic group such as 2,2,6,6-tetramethylpiperidinyl, N-methylpiperidinyl or piridyl.

Examples of the compounds represented by Formulas H and Ha are given below, but the invention is not limited thereto.

H-1

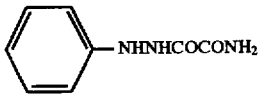

H-2

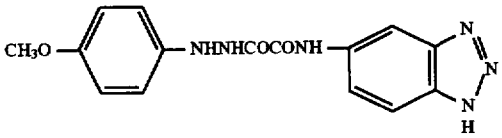

H-3

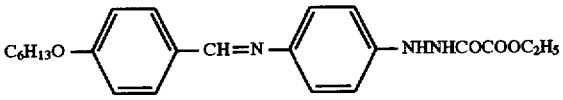

H-4

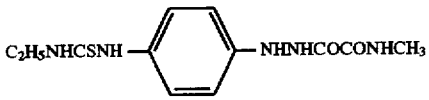

H-5

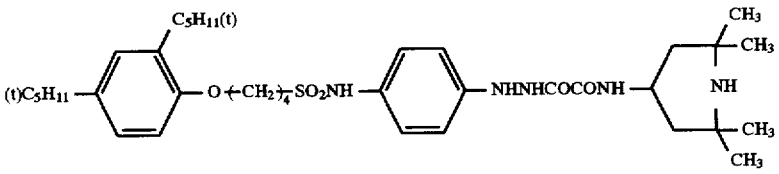

H-6

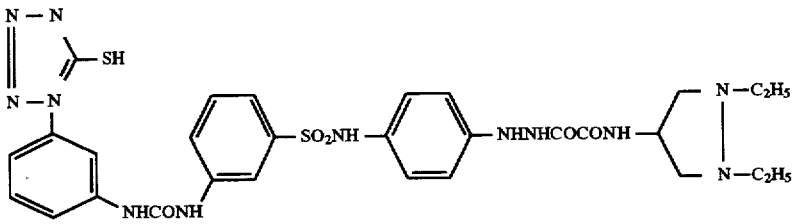

-continued
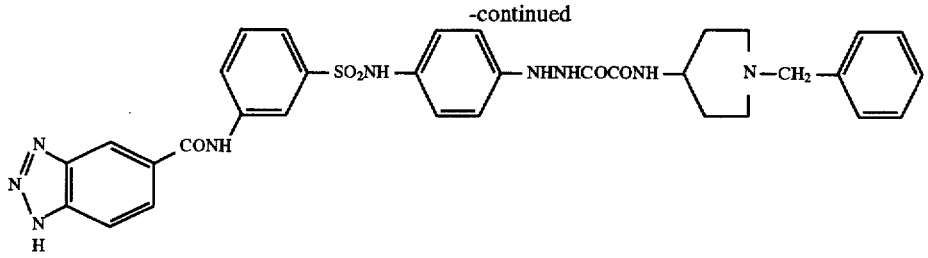
H-7
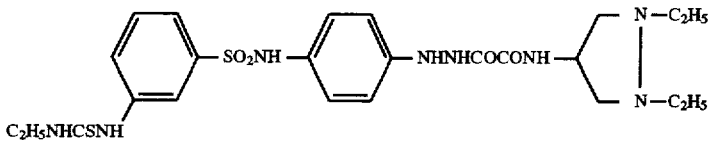
H-8
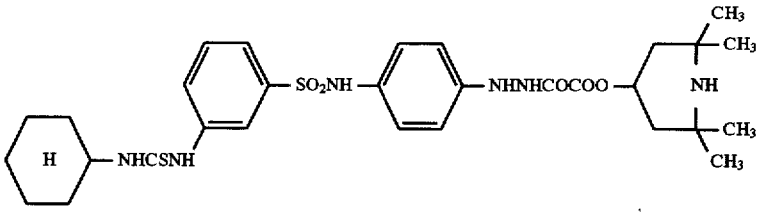
H-9
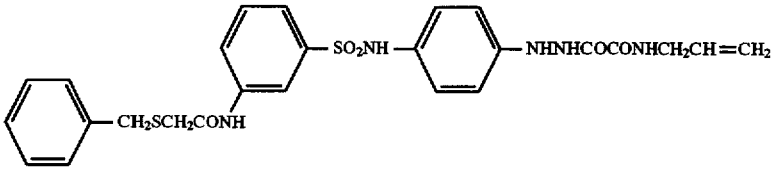
H-10
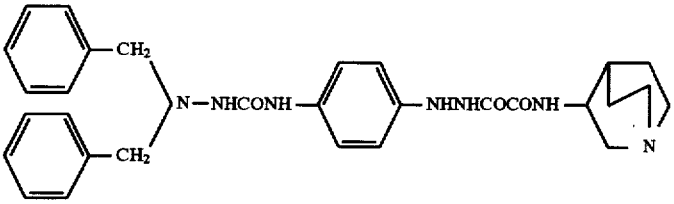
H-11
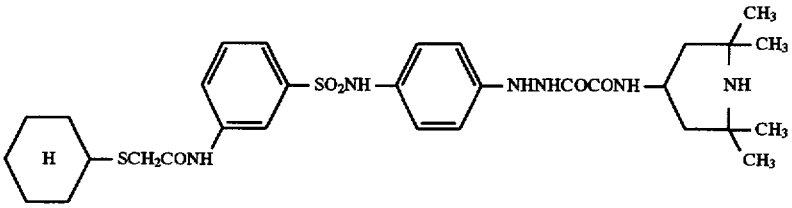
H-12
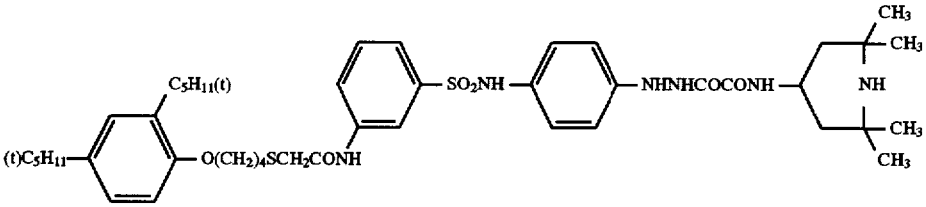
H-13
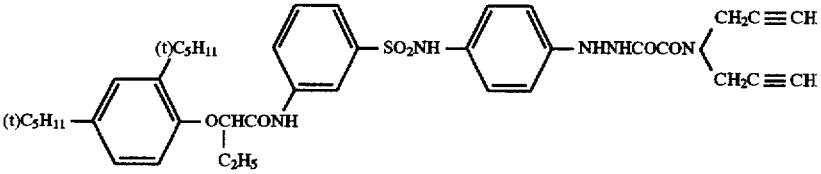
H-14

-continued
H-15
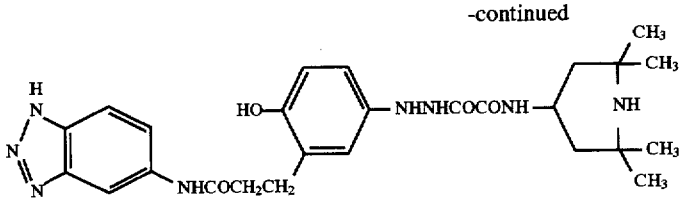
H-16
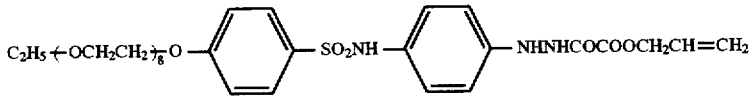
H-17
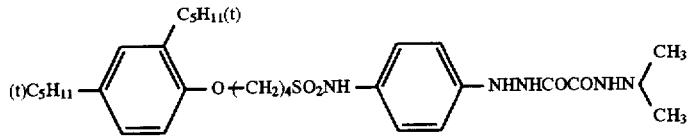
H-18
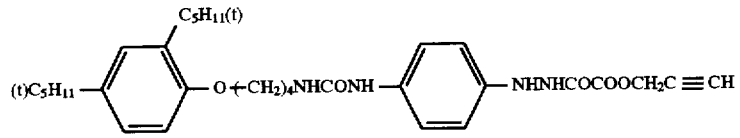
H-19
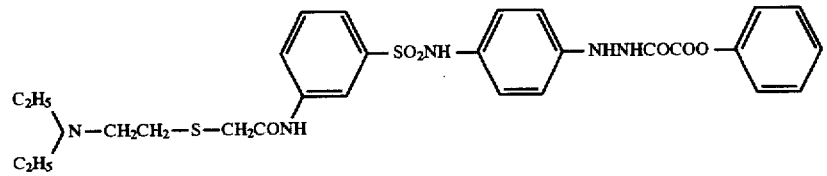
H-20
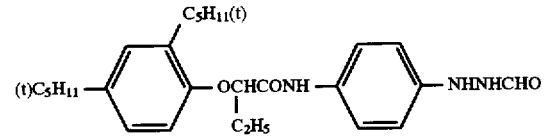
H-21
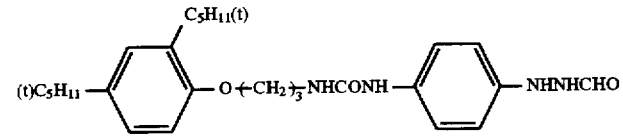
H-22
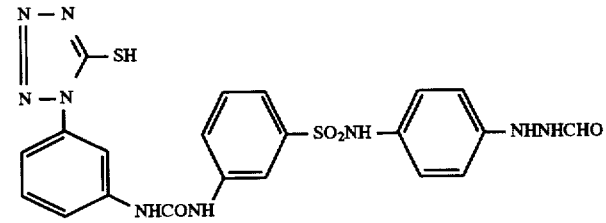
H-23
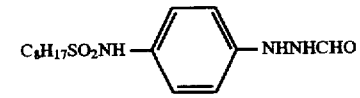
H-24
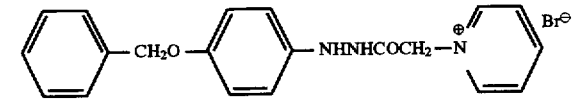
H-25
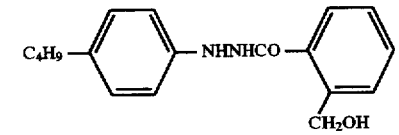

-continued
H-26
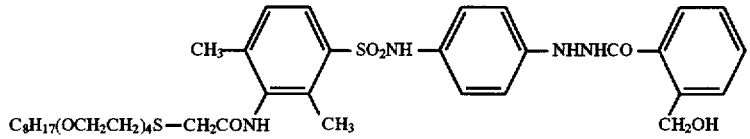
H-27
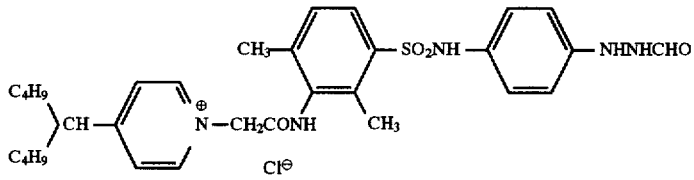
H-28
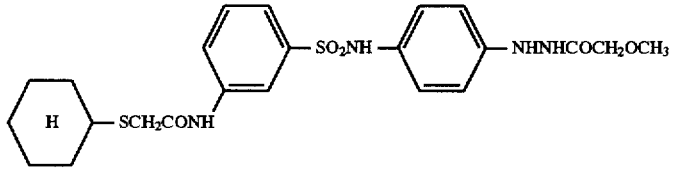
H-29
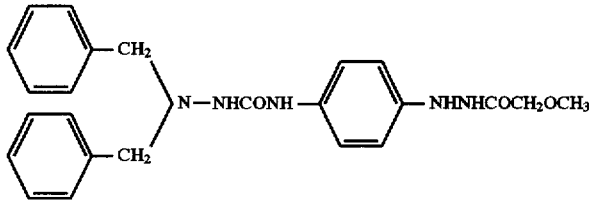
H-30
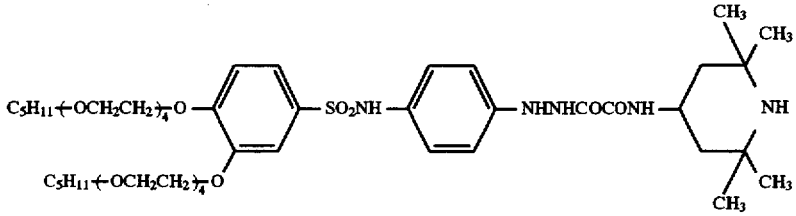
H-31
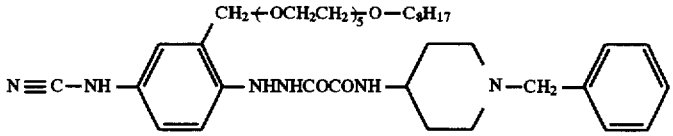
H-32
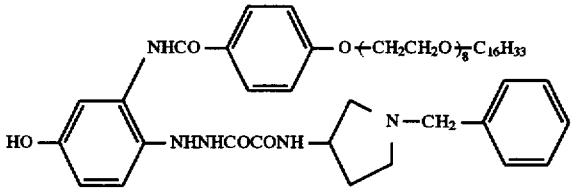
H-33
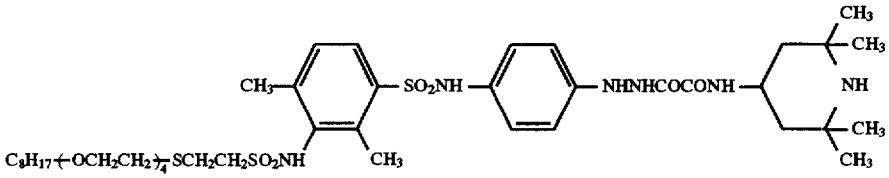

-continued
H-34
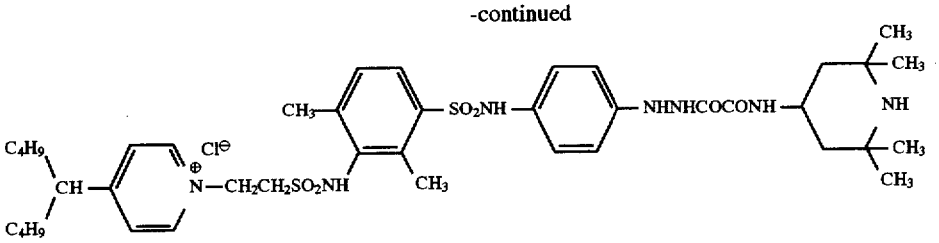
H-35
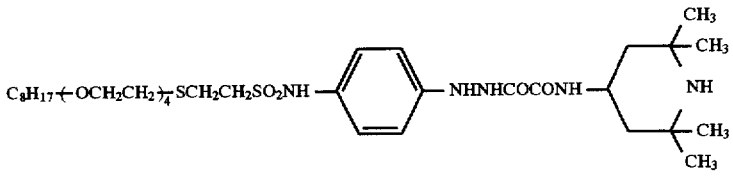
H-36
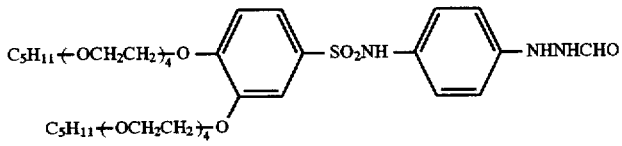
H-37
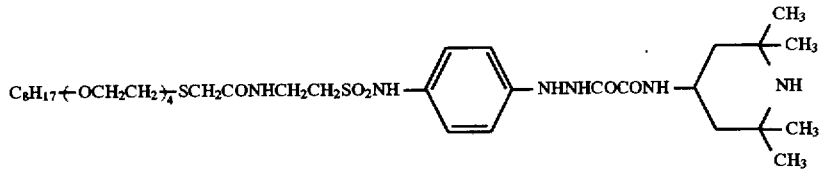
H-38
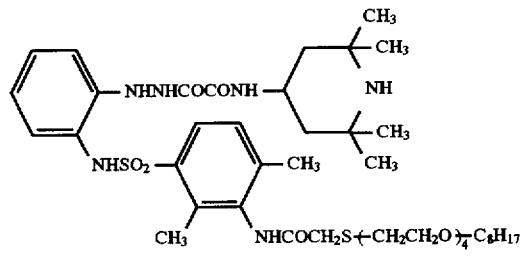
H-39
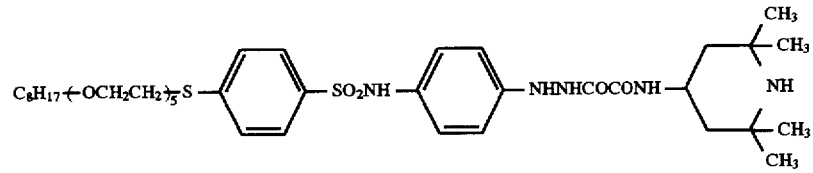
H-40
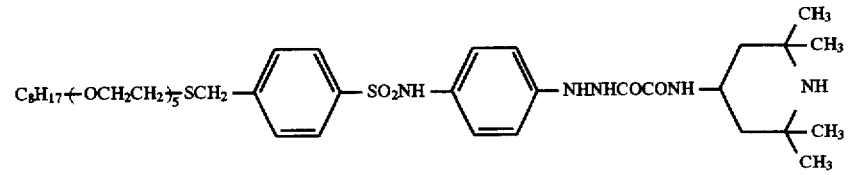
H-41
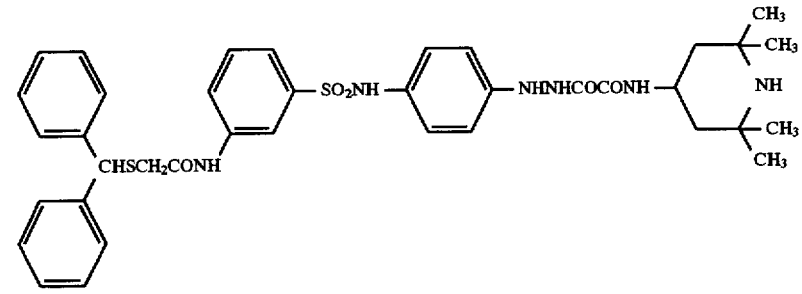

-continued

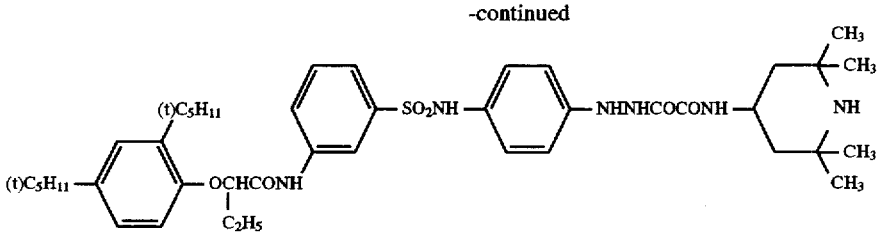

H-42

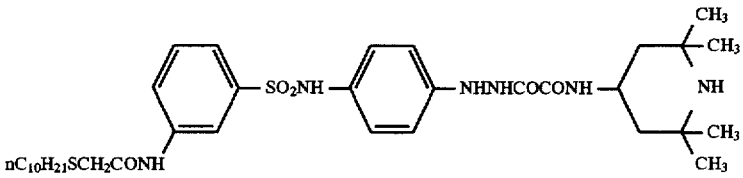

H-43

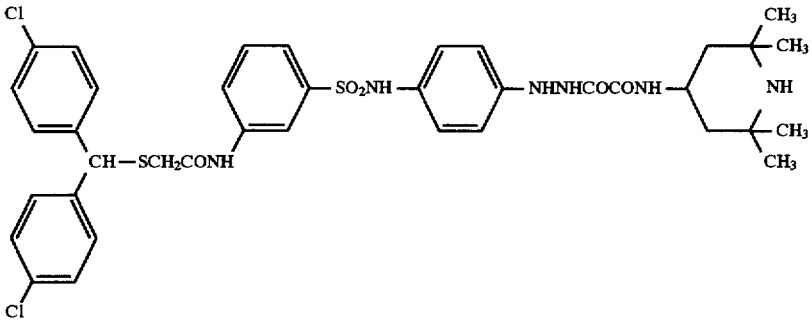

H-44

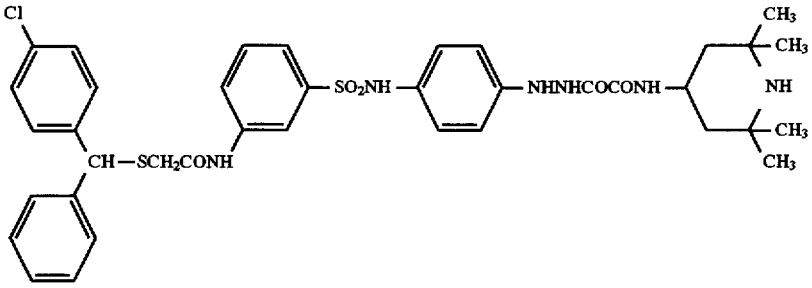

H-45

For the syntheses of the compounds represented by Formula H of the invention reference can be made to the methods described in JP O.P.I. Nos. 180361/1987, 178246/1987, 234245/1988, 234246/1988, 90439/1989, 37/1990, 841/1990, 947/1990, 120736/1990, 230233/1990 and 125134/1991; U.S. Pat. Nos. 4,686,167, 4,988,604 and 4,994,365; and European Patent Nos. 253,665 and 333,435.

The using amount of the compound of Formula H of the invention is preferably $5\times10^{-7}$ to $5\times10^{-1}$ mol, and more preferably $5\times10^{-6}$ to $5\times10^{-2}$ mol per mol of silver halide.

In the invention, in order to have the photographic light-sensitive material contain the compound of Formula H, the compound needs to be incorporated into at least one of the silver halide emulsion layer and/or a hydrophilic colloid layer adjacent to the silver halide emulsion layer.

The nucleation promoting agent used in the invention is a compound represented by the following formula Na or Nb.

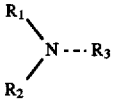

Formula Na

-continued

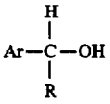

Formula Nb

In Formula Na, $R_1$, $R_2$ and $R_3$ each represent a hydrogen atom, an alkyl group, a substituted alkyl group, an alkenyl group, a substituted alkenyl group, an alkynyl group, an aryl group or a substituted aryl group, provided $R_1$, $R_2$ and $R_3$ can not represent a hydrogen atom at the same time, and may combine to form a ring. The compound is most preferably an aliphatic tertiary amine compound. The compound is preferably one having in its molecule a nondiffusible group or a silver halide adsorption group. The compound, in order to be nondiffusible, is required to have a molecular weight of not less than 100, and more preferably not less than 300. The silver halide adsorption group is preferably a heterocyclic group, a mercapto group, a thioether group, a thione group or a thiourea group.

Examples of the compound are listed below.

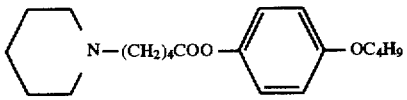

Na-1

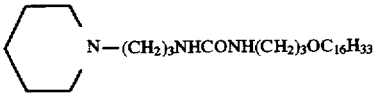

Na-2

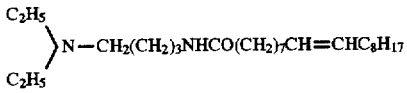

Na-3

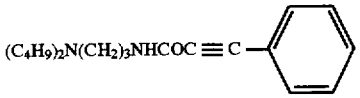

Na-4

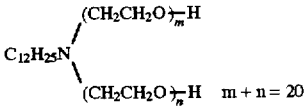

Na-5

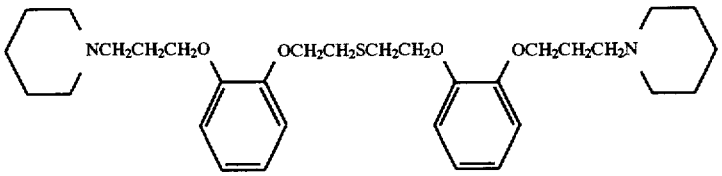

Na-6

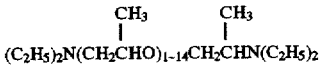

Na-7

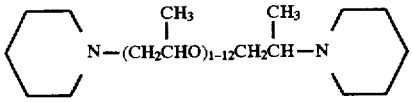

Na-8

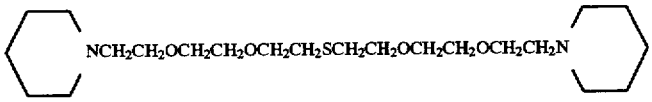

Na-9

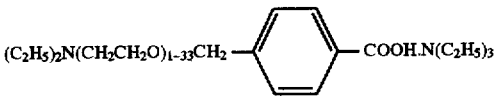

Na-10

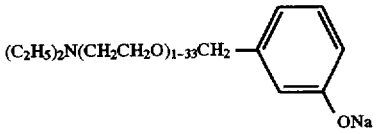

Na-11

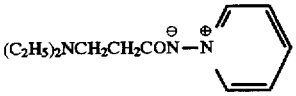

Na-12

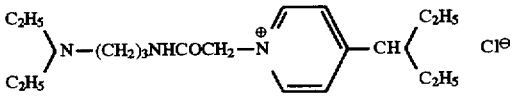

Na-13

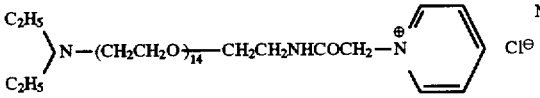

Na-14

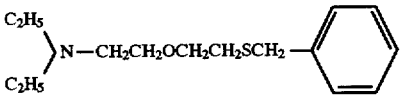

Na-15

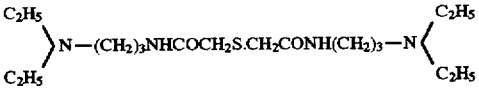

Na-16

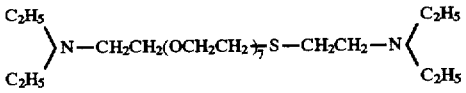

Na-17

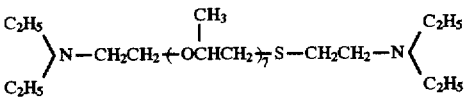

Na-18

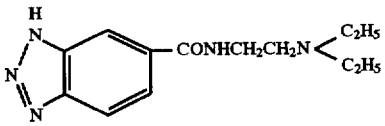

Na-19

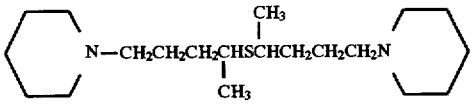

Na-20

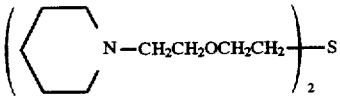

Na-21

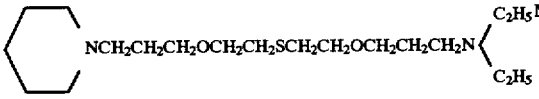

Na-22

In Formula Nb, Ar represents a substituted or unsubstituted aryl group or a heterocyclic aromatic ring; and R represents a substitutable alkyl, alkenyl, alkynyl or aryl group. The compound is preferably one having in its molecule a nondiffusible group or a silver halide adsorption group. In order to cause the compound to have a preferred nondiffusible group, the molecular weight of the compound needs to be preferably not less than 102, and more preferably not less than 300.

Examples of the compound represented by Formula Nb are given below.

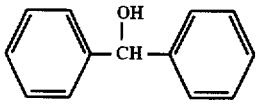
Nb-1

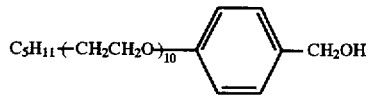
Nb-2

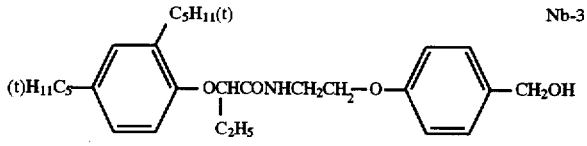
Nb-3

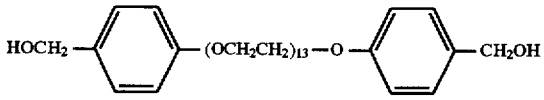
Nb-4

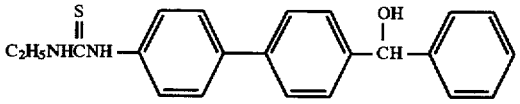
Nb-5

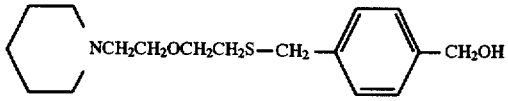
Nb-6

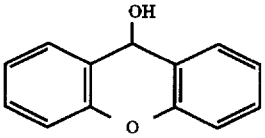
Nb-7

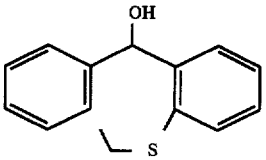
Nb-8

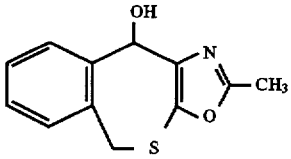
Nb-9

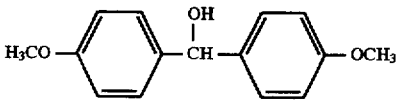
Nb-10

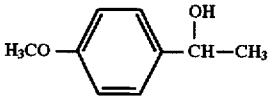
Nb-11

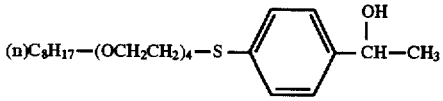
Nb-12

The light-sensitive material of the invention preferably has at least one conductive layer on its support. For the conductive layer formation there are two typical methods: one uses a water-soluble conductive polymer, a hydrophobic polymer and a hardener, while the other uses a metal oxide. These methods are described in JP O.P.I. No. 265842/1991, pp.5–6.

The silver halide emulsion of the invention (hereinafter sometimes called merely emulsion) may be arbitrary one that is used in ordinary silver halide emulsions, such as silver bromide, silver iodobromide, silver iodochloride, silver chlorobromide and silver chloride, but is preferably silver chlorobromide, silver bromide or silver iodobromide containing not more than 4 mol % silver iodide.

The emulsion is preferably of monodisperse silver halide grains having a variation coefficient of not more than 15%, wherein the variation coefficient is defined by Standard deviation of grain diameters/Average grain diameter×100

To the silver halide emulsion used in the invention may be applied various techniques and various additives which are known to those skilled in the art. For example, the silver halide emulsion and the backing layer used in the invention may have various additives incorporated thereinto by various methods, said additives including various chemical sensitizers, toning agents, hardeners, surfactants, thickeners, plasticizers, sliding agents, development inhibitors, UV absorbents, antiirradiation dyes, heavy metals, matting agents, and the like. The silver halide emulsion and the backing layer used in the invention may also contain a polymer latex.

These additives are detailed in Research Disclosure vol. 176, Item/7643 (December 1978) and vol.187, Item/8716 (Nov. 1979), in which the related sections are collectively shown below:

| Additive | RD/7643 | RD/8716 |
|---|---|---|
| 1. Chemical sensitizers | p. 23 | p. 648 right column |
| 2. Sensitivity increasing agents | | p. 648 right column |
| 3. Spectral sensitizers | p. 23–24 | p. 648 right column to p. 649 right column |
| 4. Brightening agents | p. 24 | |
| 5. Antifoggants, stabilizers | p. 24–25 | p. 649 right column |
| 6. Light absorbents, filter dyes, UV absorbents | | p. 650 left column |
| 7. Antistain agents | p. 25 right column | p. 650 left column to right column |
| 8. Dye image stabilizers | p. 25 | |
| 9. Hardeners | p. 26 | p. 651 left column |
| 10. Binders | p. 26 | p. 651 left column |
| 11. Plasticizers, lubricants | p. 27 | p. 650 right column |
| 12. Coating aids, surfactants | p. 26–27 | p. 650 right column |
| 13. Antistatic agents | p. 27 | p. 650 right column |

Materials as the support usable in the invention include cellulose acetate, cellulose nitrate, polyesters such as polyethylene terephthalate, polyolefins such as polyethylene, polystyrene, baryta paper, polyolefin-coated paper, glass, metals and the like. The support may, if necessary, be subjected to surface treatment.

The light-sensitive material of the invention, after being exposed, can be developed according to one of various methods, e.g., generally used methods.

Developing agents usable in the invention include dihydroxybenzenes such as hydroquinone, chlorohydroquinone, bromohydroquinone, 2,3-dichlorohydroquinone, methylhydroquinone, isopropylhydroquinone and 2,5-dimethylhydroquinone; 3-pyrazolidones such as 1-phenyl-3-pyrazolidone, 1-phenyl-4-methyl-3-pyrazolidone, 1-phenyl-4,4-dimethyl-3-pyrazolidone, 1-phenyl-4-ethyl-3pyrazolidone and 1-phenyl-5-methyl-3-pyrazolidone; aminophenols such as o-aminophenol, p-aminophenol, N-methyl-o-aminophenol, N-methyl-p-aminophenol and 2,4-diaminophenol; pyrogallol, ascorbic acid; 1-aryl-3-pyrazolines such as 1-(p-hydroxyphenyl)-3-aminopyrazoline, 1-(p-methylaminophenyl)-3-aminopyrazoline, 1-(p-aminophenyl)-3-aminopyrazoline, and 1-(p-amino-N-methylphenyl)-3-aminopyrazoline. These may be used alone or in combination. The preferred combination is the use of a 3-pyrazolidone with a dihydroxybenzene or an aminophenol with a hydroxybenzene. The developing agent is used preferably in a quantity of 0.01 to 1.4 mol/liter.

In the invention, as an anti-silver-sludge agent there may be used the relevant compounds described in JP E.P. No. 4702/1987, JP O.P.I. Nos. 51844/1991, 26838/1992, 362942/1992 and 319031/1989, and further, preferably compounds represented by the following Formulas Pa and Pb.

Formula Pa

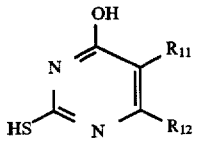

Formula Pb

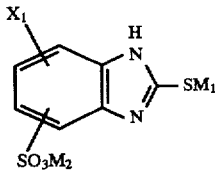

wherein $R_{11}$ and $R_{12}$ each represent a hydrogen atom, an alkyl group, an aryl group, an aralkyl group, a hydroxy group, a mercapto group, a carboxy group, a sulfo group, a phosphono group, an amino group, a nitro group, a cyano group, a halogen atom, an alkoxycarbonyl group, an aryloxycarbonyl group, a carbamoyl group, a sulfamoyl group or an alkoxy group, provided that $R_{11}$ and $R_{12}$ may combine to form a ring.

In Formula Pb, $M_1$ and $M_2$ each represent a hydrogen atom, Na, K or $NH_4$; and $X_1$ represents a hydrogen atom or a halogen atom.

The following are examples of the compounds represented by Formulas Pa and Pb.

Pa-1

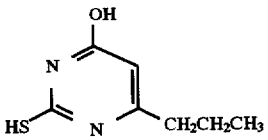

Pa-2

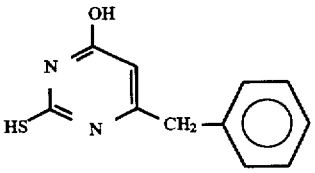

Pa-3

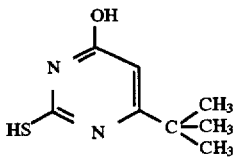

-continued

Pa-4

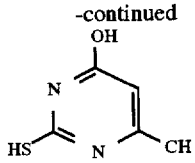

Pa-5

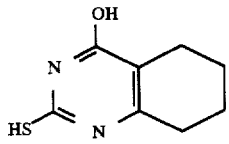

Pa-6

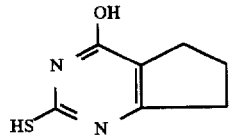

Pa-7

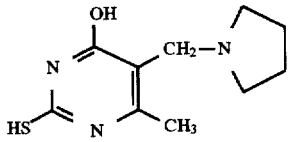

Pa-8

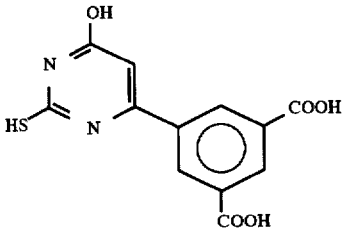

Pa-9

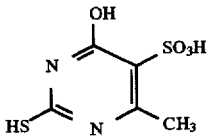

Pa-10

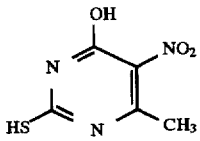

Pa-11

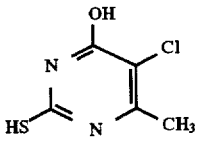

Pa-12

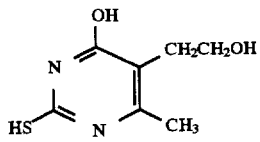

Pa-13

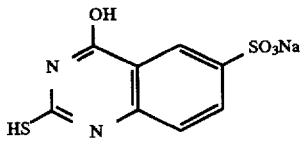

-continued
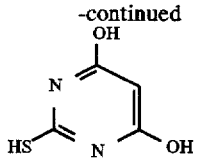
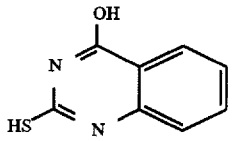
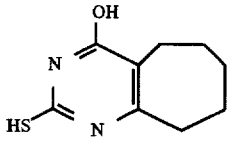
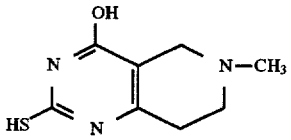
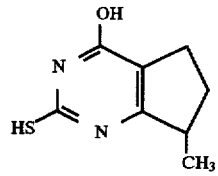
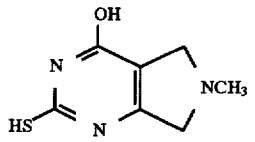
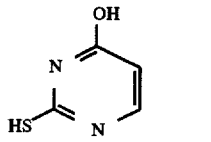
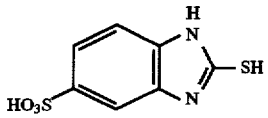
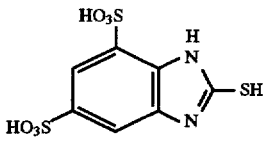
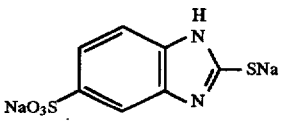
Other anti-silver-sludge agents usable in the invention include the following compounds.
Pa-14
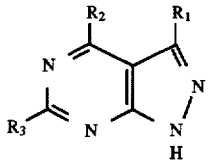
Pa-15
| | $R_1$ | $R_2$ | $R_3$ |
|---|---|---|---|
| 1 | H | H | SH |
| 2 | H | SH | H |
| 3 | $CH_3$ | H | SH |
| 4 | OH | H | SH |
| 5 | H | $NH_2$ | SH |
| 6 | Cl | SH | H |
| 7 | COOH | H | SH |
Pa-16
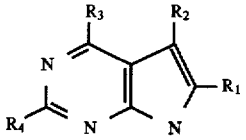
Pa-17
| | $R_1$ | $R_2$ | $R_3$ | $R_4$ |
|---|---|---|---|---|
| 8 | H | H | H | SH |
| 9 | Cl | H | H | SH |
| 10 | SH | H | H | H |
| 11 | $nC_5H_{11}$ | H | H | SH |
| 12 | OH | H | H | SH |
| 13 | H | H | OH | SH |
| 14 | SH | H | SH | H |
Pa-18
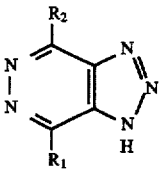
Pa-19
| | $R_1$ | $R_2$ |
|---|---|---|
| 15 | SH | H |
| 16 | SH | SH |
| 17 | SH | COOH |
| 18 | SH | $SO_3H$ |
| 19 | SH | OH |
Pa-20
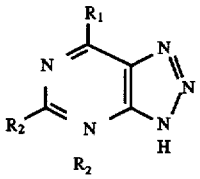
Pb-1
| | $R_1$ | $R_2$ |
|---|---|---|
| 20 | SH | H |
| 21 | SH | SH |
| 22 | SH | COOH |
| 23 | SH | $SO_3H$ |
| 24 | SH | OH |
Pb-2
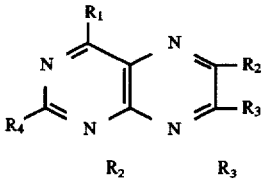
Pb-3
| | $R_1$ | $R_2$ | $R_3$ | $R_4$ |
|---|---|---|---|---|
| 25 | H | H | H | SH |
| 26 | H | H | SH | SH |
| 27 | OH | H | H | SH |
Pb-4

-continued

| | | | | |
|---|---|---|---|---|
| 28 | H | $C_5H_{11}$ | H | SH |
| 29 | SH | COOH | H | H |
| 30 | H | H | $SO_3H$ | SH |

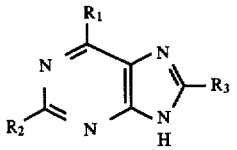

| | $R_1$ | $R_2$ | $R_3$ |
|---|---|---|---|
| 31 | SH | OH | H |
| 32 | SH | H | COOH |
| 33 | H | OH | SH |
| 34 | $SO_3H$ | SH | SH |
| 35 | H | SH | $SO_3H$ |
| 36 | $NH_2$ | H | SH |
| 37 | $NH_2$ | SH | H |
| 38 | H | $NH_2$ | SNa |
| 39 | SH | $NH_2$ | H |
| 40 | COOH | H | SH |
| 41 | H | COOH | SH |

The above-mentioned anti-silver-sludge agent is preferably contained in an amount of $10^{-6}$ to $10^{-1}$ mol per liter of a developing solution, and is more preferably contained in an amount of $10^{-5}$ to $10^{-2}$ mol per liter of a developing solution.

The preservative used in the invention is a sulfite or metabisulfite such as sodium sulfite, potassium sulfite, ammonium sulfite, sodium metabisulfite, or he like. The sulfite is used in an amount of preferably not less than 0.25 mol/liter, and more preferably not less than 0.4 mol/liter.

The developer solution used in the invention may, if necessary, contain an alkali agent such as sodium hydroxide or potassium hydroxide; a pH buffer such as a carbonate, a phosphate, a borate, boric acid, acetic acid, citric acid or an alkanolamine; a dissolution assistant such as a polyethylene glycol, an ester thereof or an alkanolamine; a sensitizer such as a nonionic surfactant containing a polyoxyethylene, a tertiary ammonium compound, etc.; a surfactant, a defoaming agent; an antifoggant such as a halide like potassium bromide or sodium bromide, nitrobenzindazole, nitrobenzimidazole, benzotriazole, benzothiazole, a tetrazole or a thiazole; a chelating agent such as ethylenediaminetetraacetic acid or an alkali metal salt thereof, a nitrilotriacetate or a polyphosphate; a development accelerator such as one of those compounds as described in U.S. Pat. No. 2,304,025 and JP E.P. No. 45541/1972; a hardener such as glutaraldehyde or a hydrogensulfite addition product thereof; and a defoaming agent. The developer solution of the invention is preferably used at a pH of 9.5 to 12.0.

The fixer solution used in the invention may be of a composition generally used. The fixer solution is generally an aqueous solution comprising a fixing agent and other necessary additives, pH of which solution is normally 3.8 to 5.8. As the fixing agent there may be used a thiosulfate such as sodium thiosulfate, potassium thiosulfate, ammonium thiosulfate; a thiocyanate such as sodium thiocyanate, potassium thiocyanate, ammonium thiocyanate; or an organic sulfur compound capable of producing a water-soluble, stable silver complex salt, known as a fixing agent.

To the above fixer solution may be added a water-soluble aluminum salt as a hardener, such as aluminum chloride, aluminum sulfate, potassium alum, or the like.

The fixer solution may, if necessary, contain a preservative such as a sulfite or hydrogensulfite; a pH buffer such as acetic acid; a pH control agent such as sulfuric acid; and a water-softening chelating compound.

The developer used in the invention may be prepared in the form of a mixture of solid components, an organic aqueous solution containing glycol or amine or a highly viscous pasty solution so as to be either diluted before use or used as it is.

The development temperature in the invention may be in a normal range of from 20° to 30° C. or may be set as high as 30° to 40° C.

To meet the demand for shorter processing time, the overall processing (dry to dry) time in an automatic processor required for film to travel from its insertion to ejection from the drying section is preferably 20 to 120 seconds. The overall processing time herein includes total time necessary for processing the light-sensitive material; e.g., the dry-to-dry time including periods necessary for developing, fixing, bleaching, washing, stabilizing, drying and the like. If the overall processing time is shorter than 20 seconds, no satisfactory photographic performance characteristic can be obtained accompanied with low-contrast trouble. The overall processing time (dry to dry) is more preferably 30 to 120 seconds.

EXAMPLES

The invention is illustrated in detail by the following examples, but the embodiment of the invention is not limited thereto.

Example 1

Preparation of silver halide Emulsion A of the invention

A silver chloroiodobromide emulsion comprised of 70 mol % silver chloride, 0.2 mol % silver iodide and the rest being silver bromide was prepared by using a double-jet precipitation process. At the time of the double-jet process, $K_3RhBr_6$ was added in an amount of $8.1\times10^{-8}$ mol per mol of silver. The obtained emulsion was of monodisperse cubic grains having a variation coefficient of 9% and an average grain diameter of 0.20μm. Then, the emulsion was desalted by using a denatured gelatin that is one whose amino group is substituted by phenylcarbamyl, such as the exemplified compound G-8 described in JP O.P.I. No. 280139/1990. EAg after the desalting was 190 mv at The obtained emulsion, after adjusting pH to 5.58 and EAg to 123 mv, was heated to 60° C. to have chloroauric acid in an amount of $2.2\times10^{-5}$ mol per mol of silver added thereto and stirred for two minutes, and after adding $S_8$ in an amount of $2.9\times10^{-6}$ mol per mol of silver thereto, the emulsion was subjected to chemical sensitization for 78 minutes. At the time of completion of the ripening, 4-hydroxy-6-methyl-1,3,3a,7-tetrazaindene in an amount of $7.5\times10^{-3}$ mol, 1-phenyl-5-mercaptotetrazole in an amount of $3.5\times10^{-4}$ mol per mol of silver and 28.4 g of gelatin were added, whereby silver halide Emulsion A was prepared.

Preparation of silver halide photographic light-sensitive material of the invention On the subbed surface of a polyethylene terephthalate film of 100 μm in thickness that was subjected to the antistatic treatment described in Example 1 of JP O.P.I. No. 92175/1991 was coated a silver halide emulsion of the following prescription containing the above-prepared silver halide Emulsion A so as to have a silver coating weight of 3.3 g/m$^2$ and a gelatin coating weight of 2.6 g/m$^2$. Further, on the layer was coated a coating liquid of the following Prescription 2 for forming a protective layer so as to have a gelatin coating weight of 1 g/m$^2$. On the subbed surface of the other side of the film was coated a backing layer according to the following Prescription 3 so as to have a gelatin coating weight of 2.7 g/m$^2$, and further on the backing layer was coated a protective layer of the following Prescription 4 so as to have a gelatin coating weight of 1 g/m$^2$, whereby six different samples No.I-1 to I-6 were prepared as shown in Table 1.

Prescription 1 (silver halide emulsion composition)

Sensitizing dyes

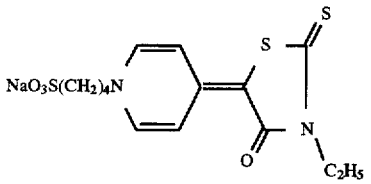

75 mg/mol Ag

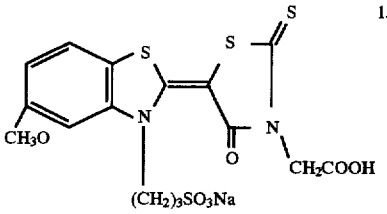

150 mg/mol Ag

Hydrazine derivative
Exemplified compound H-45 — 500 mg/mol Ag

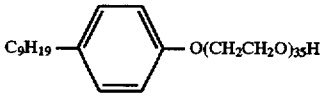

100 mg/m$^2$

Nucleus-forming agent
Exemplified compound Na-12 — $1 \times 10^{-3}$ mol/mol Ag Latex polymer

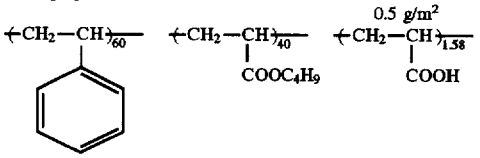

0.5 g/m$^2$

Dye — Amount in Table 1
Exemplified compound I-21

Hardener

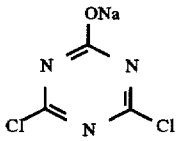

60 mg/m$^2$

| | |
|---|---|
| Silver halide emulsion A | 3.3 g/m$^2$ |
| S-1 (Sodium iso-amyl-n-decylsulfosuccinate) | 0.64 mg/m$^2$ |
| 2-Mercapto-6-hydroxypurine | 1.7 g/m$^2$ |
| EDTA | 50 mg/m$^2$ |

Prescription 2 (emulsion protective layer composition)

| | |
|---|---|
| S-1 | 12 mg/m$^2$ |
| Matting agent: monodisperse silica average particle size: 3.5 μm | 22 mg/m$^2$ |
| 1,3-vinylsulfonyl-2-propanol | 40 mg/m$^2$ |
| Surfactant | |

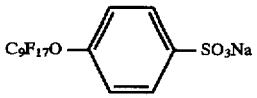

0.6 mg/m$^2$

-continued

| | |
|---|---|
| Polymer hardener | 10 mg/m$^2$ |

Prescription 3 (backinq layer composition)

| | |
|---|---|
| Saponin | 133 mg/m$^2$ |
| S-1 | 6 mg/m$^2$ |
| Colloidal silica | 100 mg/m$^2$ |

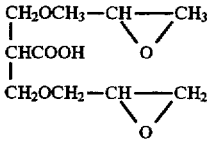

100 mg/m$^2$

Prescription 4 (backing layer composition)

| | |
|---|---|
| Matting agent: monodisperse polymethyl methacrylate, average particle size: 5.0 μm | 50 mg/m$^2$ |
| Sodium di-(2-ethylhexyl)-sulfosuccinate | 10 mg/m$^2$ |

Each of the obtained Samples No.I-1 to I-6 was subjected to scanning exposure treatment by using a scanner DC-381T with an Ar laser light (488 nm), manufactured by Linotype-hell Co., in which each sample was exposed to the laser light, which was set so as to produce 5% small-dot and 50% middle-dot solid densities at a scanning density of 400 lines/inch with the quantity of the light being varied, wherein the exposure amount was to give a density of 5.0 to the solid density area. The obtained samples each were processed in developer and fixer solutions of the following compositions under the following conditions by using a rapid-processing-type autoprocessor GR-26SR, manufactured by KONICA Corp.

Processing conditions

| Step | Temperature | Time |
|---|---|---|
| Developing | 35° C. | 30 seconds |
| Fixing | 33° C. | 20 seconds |
| Washing | Normal temperature | 20 seconds |
| Drying | 40° C. | 40 seconds |

Developer solution

| | |
|---|---|
| Sodium sulfite | 55 g/liter |
| Potassium carbonate | 40 g/liter |
| Hydroquinone | 24 g/liter |
| 4-Methyl-4-hydroxymethyl-1-phenyl-3-hydrazolidone (Dimezone S) | 0.9 g/liter |
| Potassium bromide | 5 g/liter |
| 5-Methyl-benzotriazole | 0.13 g/liter |
| Boric acid | 2.2 g/liter |
| Diethylene glycol | 40 g/liter |
| Exemplified compound P-1 | 60 mg/liter |
| Add water/potassium hydroxide to make 1 liter/pH 10.5. | |

Fixing solution

| | |
|---|---|
| Ammonium thiosulfate (aqueous 72.5% W/V solution) | 240 ml |
| Sodium sulfite | 17 g |
| Sodium acetate, trihydrate | 6.5 g |
| Boric acid | 6.0 g |
| Sodium citrate, dihydrate | 2.0 g |
| Pure water (dionized) | 17 mg |
| Sulfuric acid (aqueous 50% W/V solution) | 4.7 g |
| Aluminum sulfate (aqueous solution in 8.1% W/V $Al_2O_3$ equivalent) | 26.5 g |

For preparation of a fixing solution, the above components were dissolved in the order given in 500 ml of water, and water was added to make the whole 1 liter. pH of the fixing solution was adjusted to 4.8 with acetic acid.

The obtained sample was measured for its halftone dot percentage by use of a measuring instrument X-Rite361T.

Instead of the middle-size halftone dots, 30μm-size halftone dots were used to examine changes in the dot percentage thereof by varying exposure amount, and the difference between the dot percentage obtained in an exposure amount to give a solid density of 5.0 and the dot percentages obtained when varying exposure amount by ±25% therefrom was measured.

The processed sample was used as an original, and a contact reversal film RCL, produced by KONICA Corp., was exposed in the contact printing manner through the original to a light in an exposure amount to give a solid density of 5.0 by using a daylight printer P-627FM, manufactured by Dai-Nippon Screen Co. The exposed reversal film was then processed in developer and fixer solutions of the following compositions under the following conditions in an automatic processor GR-27, manufactured by KONICA Corp.

Similarly, the halftone dot percentage was measured with a measuring instrument X-Rite361T.

Processing conditions

| Step | Temperature | Time |
|---|---|---|
| Developing | 28° C. | 30 seconds |
| Fixing | 28° C. | 20 seconas |
| Washing | 25° C. | 20 seconds |
| Drying | 40° C. | 30 seconds |

Developer solution

| | |
|---|---|
| Composition A: | |
| Pure water (deionized) | 150 ml |
| Disodium ethylenediaminetetraacetate | 2 g |
| Diethylene glycol | 50 g |
| Potassium sulfite (aqueous 55% W/V solution) | 100 ml |
| Potassium carbonate | 50 g |
| Hydroquinone | 15 g |
| 1-Phenyl-5-mercaptotetrazole | 30 mg |
| Potassium hydroxide | amount for adjusting pH to 10.4 |
| Potassium bromide | 4.5 g |
| Composition B: | |
| Pure water (deionized) | 3 ml |
| Disodium ethylenediaminetetraacetate | 25 mg |
| Diethylene glycol | 50 g |
| Acetic acid (aqueous 90% solution) | 0.3 ml |
| 1-Phenyl-3-pyrazolidone | 700 mg |

For preparation of a developer solution, the above Composition A and Composition B were dissolved in the order given in 500 ml of water, and water was added to make the whole 1 liter.

Fixing solution

| | |
|---|---|
| Composition A: | |
| Ammonium thiosulfate (aqueous 72.5% W/V solution) | 240 ml |
| Sodium sulfite | 17 g |
| Sodium acetate, trihydrate | 6.5 g |
| Boric acid | 6.0 g |
| Sodium citrate, dihydrate | 2.0 g |

-continued

Fixing solution

| | |
|---|---|
| Acetic acid (aqueous 90% solution) | 13.6 mg |
| Composition B: | |
| Pure water (deionized) | 17 mg |
| Sulfuric acid (aqueous 50% W/V solution) | 4.7 g |
| Aluminum sulfate (aqueous solution in 8.1% W/V $Al_2O_3$ equivalent) | 26.5 g |

For preparation of a fixing solution, the above Composition A and Composition B were dissolved in the order given in 500 ml of water, and water was added to make the whole one liter. pH of this fixing solution was approximately 4.3.

Criteria for evaluating small-size dot percentage

The resulting dot percentage of small-size halftone dots (target: 5%) in an exposure amount to give a solid density of 5.0. The closer to 5% the resulting percentage, the better.

Criteria for evaluating middle-size dot percentage

The resulting dot percentate of middle-size halftone dots (target: 50%) in an exposure amount to give a solid density of 5.0. The closer to 50% the resulting percentage, the better.

Criteria for evaluating dependence upon exposure

An exposure amount value is found which causes the middle-size halftone dots whose dot percentage is to be theoretically 50% to actually give 50% halftone dots; from the above value the exposure amount is varied by ±25% to produce halftone dot percentage values Da and Db, and the difference between Da and Db is evaluated as the dependence upon exposure of the halftone dot percentage in the proximity of the optimum exposure amount.

Criteria for evaluating day-light reversal halftone dot percentage

In halftone dots that have been obtained in a daylight reversal processing, the halftone dot percentage of an negative image corresponding to the small-size halftone dots of the original image used. The closer to 95% the resulting percentage, the better.

Criteria for evaluating halftone dot quality

The halftone dot quality data in the following table are the results of visual evaluation of dots by using a 100-power magnifying glass. The halftone dots were subjected to the following 5-grade evaluation, wherein grade 5 represents the best, which is followed by grades 4, 3, 2 and 1 representing good, normal, poor and bad, respectively. Those dots evaluated as grades 2 and 1 are on levels unacceptable for practical use. The test results obtained by adjusting the exposure wavelength to Ar laser light (wavelength: 488 nm) are shown in Table 1.

TABLE 1

| Sample No. | Dye I-21 mg/mol of Ag | * Δλmax (nm) | Hydrazine H-45 500 mg/mol of Ag | Small-size halfton dots(%) | Middle-size halftone dots(%) | Dependence on exposure amount | Daylight reversal halftone dots(%) | Dot quality |
|---|---|---|---|---|---|---|---|---|
| I-1 (Comp.) | 0 | — | Present | 1.02 | 58 | 15 | 99.0 | 5 |
| I-2 (Inv.) | 25 | 22 | Present | 4.1 | 55 | 13 | 95.6 | 5 |
| I-3 (Inv.) | 50 | 22 | Present | 4.7 | 53 | 11 | 95.4 | 5 |
| I-4 (Inv.) | 100 | 22 | Present | 5.0 | 51 | 10 | 95.1 | 5 |
| I-5 (Inv.) | 25 | 22 | None | 6.5 | 54 | 11 | 95.5 | 3 |
| I-6 (Comp.) | 0 | — | None | 4.0 | 62 | 14 | 98.5 | 3 |

*Maximum absorption wavelength of emulsion-maximum absorption wavelength of dye

As is apparent from Table 1, the light-sensitive material of the invention shows optimal small-size halftone dot percentage, middle-size halftone dot percentage and daylight reversal halftone dot percentage values and little dependence on exposure amount, and is excellent in the halftone dot quality.

As a result, each of the above samples enables to obtain satisfactory photographic performance characteristics capable of providing a highly clear-cut and good small-size halftone dot reproducibility-having photographic image in a high-precision printing process.

Example 2

Preparation, experiments and evaluation of Samples II-1 to II-6 were carried out in the same manner as in Example 1 except that the sensitizing dye and other dye were replaced by the following materials, and each sample was exposed to a helium neon laser light (wavelength: 633 nm) scanning in 700 lines/inch of a scanner SG-747, manufactured by Dai-Nippon Screen Co. The results are shown in Table 2.

The sensitizing dye and other dye used:

Sensitizing dye

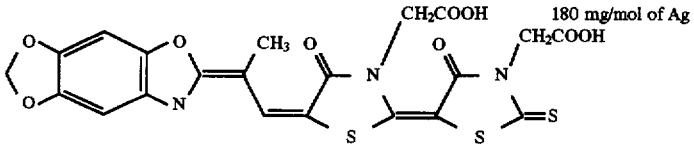

Dye
Exemplified compound II-20

Amount shown in Table 2

As is apparent from Table 2, the light-sensitive material of the invention shows satisfactory small-size halftone dot percentage, middle-size halftone dot percentage and daylight reversal halftone dot percentage values as in Example 1 even when the sensitizing dye and other dye are changed and the light source is replaced by the helium neon laser light as in above, has little dependence on exposure amount, and is excellent in the halftone dot quality. As a result, each of the above samples enables to obtain satisfactory photographic performance characteristics capable of providing a highly clear-cut and good small-size halftone dot reproducibility in a high precision printing process.

EXAMPLE 3

Sample s II-2 to III-6 were prepared in the same manner by using the same sensitizing dye and other dye as in Example 2, and experiments and evaluation of the samples were conducted in the same manner as in Example 2 except that each sample was exposed to LD light (wavelength: 670 nm) scanning in 305 lines/inch (2540 dpi) of an Image-setter Hurkules.

The results are shown in Table 3.

TABLE 2

| Sample No. | Dye II-20 mg/mol of Ag | * Δλmax (nm) | Hydrazine H-45 500 mg/mol of Ag | Small-size halfton dots(%) | Middle-size halftone dots(%) | Dependence on exposure amount | Daylight reversal halftone dots(%) | Dot quality |
|---|---|---|---|---|---|---|---|---|
| II-1 (Comp.) | 0 | — | Present | 1.0 | 57 | 16 | 99.1 | 5 |
| II-2 (Inv.) | 10 | 5 | " | 4.1 | 55 | 14 | 95.7 | 5 |
| II-3 (Inv.) | 20 | 5 | " | 4.6 | 54 | 12 | 95.5 | 5 |
| II-4 (Inv.) | 40 | 5 | " | 4.8 | 52 | 10 | 95.0 | 5 |
| II-5 (Inv.) | 10 | 5 | None | 6.2 | 55 | 12 | 95.8 | 3 |
| II-6 (Comp.) | 0 | — | None | 4.3 | 59 | 14 | 99.2 | 3 |

* Maximum absorption wavelength of emulsion-maximum absorption wavelength of dye

TABLE 3

| Sample No. | Dye II-20 mg/mol of Ag | * Δλmax (nm) | Hydrazine H-45 500 mg/mol of Ag | Small-size halfton dots(%) | Middle-size halftone dots(%) | Dependence on exposure amount | Daylight reversal halftone dots(%) | Dot quality |
|---|---|---|---|---|---|---|---|---|
| III-1 (Comp.) | 0 | — | Present | 1.0 | 60 | 16 | 99.0 | 5 |
| III-2 (Inv.) | 10 | 5 | " | 4.1 | 57 | 14 | 95.8 | 5 |
| III-3 (Inv.) | 20 | 5 | " | 4.7 | 54 | 13 | 95.4 | |
| III-4 (Inv.) | 40 | 5 | " | 5.1 | 53 | 11 | 95.3 | 5 |
| III-5 (Inv.) | 10 | 5 | None | 5.8 | 56 | 12 | 96.0 | |
| III-6 (Comp.) | 0 | — | None | 4.2 | 63 | 15 | 99.0 | 3 |

* Maximum absorption wavelength of emulsion-maximum absorption wavelength of dye As is apparent from Table 1, the light-sensitive material of the invention shows satisfactory small-size halftone dot percentage, middle-size halftone dot percentage and daylight reversal halftone dot percentage value s even when the light source is replaced by an LD light, has little dependence on exposure amount, and has a suitable halftone dot quality for practical use. As a result, each of the above samples enables to obtain satisfactory photographic performance characteristics capable of providing a highly clear-cut and good small-size halftone dot reproducibility in a high-precision printing process.

Example 4

Preparation, experiments and evaluation of samples IV-1 to IV-6 were conducted in the same manner as in Example 1 except that the sensitizing dye and other dye used in Example 1 were replaced by the following compounds, and each sample was exposed to a IR light (wavelength: 780 nm) equipped in a recorder MT-R1120, manufactured by Dai-Nippon Screen Co. The results are shown in Table 4.

The sensitizing dyes and other dye used:

Sensitizing dyes

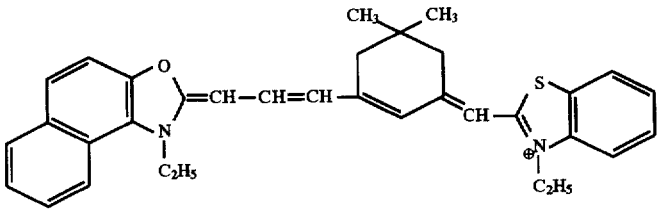

15 mg/mol of Ag

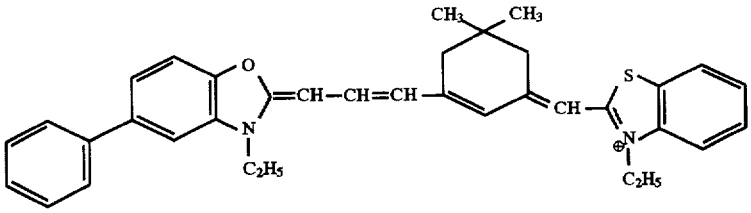

15 mg/mol of Ag

Dye

Exemplified compound IV-7 described in Table 4

TABLE 4

| Sample No. | Dye IV-7 mg/mol of Ag | * Δλmax (nm) | Hydrazine H-45 500 mg/mol of Ag | Small-size halfton dots(%) | Middle-size halftone dots(%) | Dependence on exposure amount | Daylight reversal halftone dots(%) | Dot quality |
|---|---|---|---|---|---|---|---|---|
| IV-1 (Comp.) | 0 | — | Present | 1.2 | 58 | 14 | 99.2 | 5 |
| IV-2 (Inv.) | 10 | 20 | " | 4.2 | 55 | 13 | 95.8 | 5 |
| IV-3 (Inv.) | 20 | 20 | " | 5.0 | 54 | 12 | 95.3 | 5 |
| IV-4 (Inv.) | 40 | 20 | " | 5.3 | 53 | 10 | 95.0 | 5 |
| IV-5 (Inv.) | 10 | 20 | None | 6.1 | 57 | 13 | 95.9 | 3 |
| IV-6 (Comp.) | 0 | — | None | 4.3 | 65 | 15 | 99.2 | 3 |

* Maximum absorption wavelength of emulsion-maximum absorption wavelength of dye As is apparent from Table 2, the light-sensitive material of the invention shows satisfactory small-size halftone dot percentage, middle-size halftone dot percentage and daylight reversal halftone dot percentage values even when the sensitizing dye and other dye are changed as in above and the light source is changed to the IR light, has little dependence on exposure amount, and is excellent in the halftone dot quality. As a result, each of the above samples enables to obtain satisfactory photographic performance characteristics capable of providing a highly clear-cut and good small-size halftone dot reproducibility in a high-precision printing process.

Example 5

Samples were prepared in the same manner as in the Samples I-3, II-3, III-3 and IV-3 used Examples 1, 2, 3 and 4, respectively, except that a surfactant and gelatin (each 0.5 g/m$^2$, 1.0 g/m$^2$, 2.0 g/m$^2$) were coated between the emulsion layer and the support of each of Samples I-3, II-3, III-3 and IV-3, and the samples prepared herein were designated as Samples I-3 ((1)–(3)), II-3 ((1)–(3)), III-3 ((1)–(3)) and IV-3((1)–(3)).

Experiments of the above samples were conducted by using the respective light sources used in the foregoing examples.

The results are shown in Table 5.

TABLE 5

| Sample No. | Exposure wavel-length (nm) | Bottom layer gelatin amt g/m$^2$ | Small-size halftone dots(%) | Middle-size halftone dots(%) | Depend-ence on exposure amount | Daylight reversal halftone dots(%) | dot qual-ity |
|---|---|---|---|---|---|---|---|
| I-3-(1)(Inv.) | 488 | 0.5 | 5.0 | 51 | 4 | 95.6 | 5 |
| -(2)(Inv.) | 488 | 1.0 | 5.1 | 51 | 3 | 95.3 | 5 |
| -(3)(Inv.) | 488 | 2.0 | 5.1 | 50 | 3 | 95.2 | 5 |
| II-3-(1)(Inv.) | 633 | 0.5 | 4.9 | 52 | 4 | 95.2 | 5 |
| -(2)(Inv.) | 633 | 1.0 | 5.1 | 51 | 4 | 94.8 | 5 |
| -(3)(Inv.) | 633 | 2.0 | 5.1 | 50 | 3 | 94.9 | 5 |
| III-3-(1)(Inv.) | 670 | 0.5 | 4.8 | 51 | 5 | 95.2 | 5 |
| -(2)(Inv.) | 670 | 1.0 | 5.0 | 51 | 4 | 95.1 | 5 |
| -(3)(Inv.) | 670 | 2.0 | 5.1 | 50 | 4 | 94.8 | 5 |
| IV-3-(1)(Inv.) | 780 | 0.5 | 4.9 | 52 | 5 | 94.9 | 5 |
| -(2)(Inv.) | 780 | 1.0 | 5.1 | 50 | 3 | 95.0 | 5 |
| -(3)(Inv.) | 780 | 2.0 | 5.1 | 50 | 3 | 95.1 | 5 |

As is apparent from Table 5, the providing of a hydrophilic colloid layer between the support and the emulsion layer of each sample brings satisfactory results that the reproducibility of small-size halftone dot percentage nears to 5%, and that of middle-size halftone dot percentage nears to 50%.

Example 6

The Samples II-1 and II-5 of Example 2 and the Samples II-3((1)–(3)) of Example 5 were used to conduct practical FM screening process, in which an exposure output was made at a resolution of 3600 dpi (dot per inch) by using an image setter Select Set 5000, manufactured by Agfa Gevart Co. A Macintosh computer was used with a test pattern to make an output of 50% halftone dots, and exposure amount was varied within limits of the light giving halftone dot 50% ±25% to look into changes in the halftone dot percentage. The results are shown in Table 6.

TABLE 6

| Sample No. | Dependence on exposure amount (%) |
|---|---|
| II-1 (Comp.) | 34 |
| -2 (Inv.) | 24 |
| -3 (Inv.) | 21 |
| II-3-(1) (Inv.) | 16 |
| -3-(2) (Inv.) | 15 |
| -3-(3) (Inv.) | 12 |
| II-4 (Inv.) | 13 |
| II-5 (Inv.) | 23 |
| II-6 (Comp.) | 32 |

As is apparent from Table 6, the light-sensitive material of the invention, in FM screening process, can provide a method of forming a stable image having little dependence upon exposure amount.

Example 7

Samples V-2 to V-5 were prepared in the same manner as in Example 2 except that in place of the Dye II-20 (hydrophilic), Dye II-3 (hydrophobic) was used, which was pulverized by a ball mill into 0.08μm-size particles and added so as to have the same transmission densities in the state of solid dispersion at 635 nm as the transmission densities of the Samples II-2 to II-5 prepared by using Dye II-2 in Example 2. The prepared samples were evaluated in the same manner as in Example 2. The results are shown in Table 7.

TABLE 7

| Sample No. | Small-size halftone dots (%) | Middle-size halftone dots (%) | Dependence on exposure amount | Daylight re-versal half-tone dots (%) | Dot qual-ity |
|---|---|---|---|---|---|
| V-2 (Inv.) | 4.2 | 52 | 10 | 95.5 | 5 |
| V-3 (Inv.) | 4.9 | 51 | 8 | 95.3 | 5 |
| V-4 (Inv.) | 5.0 | 51 | 7 | 95.0 | 5 |
| V-5 (Inv.) | 6.1 | 53 | 9 | 95.6 | 3 |

As is apparent from Table 7, Example 7, which uses the dye in the form of a solid dispersion, is more excellent in the dependence upon exposure as well as in the middle-size halftone dot characteristics, than Example 2.

What is claimed is:

1. A silver halide photographic light-sensitive material, comprising a support, said support having thereon a light-sensitive silver halide emulsion layer and a layer adjacent to said light-sensitive emulsion layer, wherein at least one said layer includes a dye having a maximum absorption at a wavelength within about ±22 nm from a maximum sensitivity wavelength of said light-sensitive silver halide emulsion layer, wherein said dye is contained in an amount of 0.001 to 0.3 in terms of an absorbance at said maximum absorption wavelength, and at least one of said layers containing a hydrazine compound represented by Formula H:

Formula H

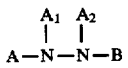

wherein A represents alkyl, aryl, or a heterocycle; B represents acyl, alkyl sulfonyl, arylsulfonyl, alkylsulfinyl, arylsulfinyl, carbamoyl, alkoxycarbonyl, aryloxycarbonyl, sulfamoyl, sulfinamoyl, alkoxysulfonyl, thioacyl, thiocarbamoyl, acylcarbonyl, or a heterocycle; $A_1$ and $A_2$ independently represent hydrogen, acyl, sulfonyl, or oxalyl.

2. A silver halide photographic light-sensitive material, comprising a support, said support having thereon a light-sensitive silver halide emulsion layer and a layer adjacent to said light-sensitive emulsion layer, wherein at least one said layer contains a dye having a maximum absorption at a wavelength within about ±22 nm from a maximum sensitivity wavelength of said light-sensitive silver halide emulsion layer and said dye is a dispersion of solid particles dispersed in a hydrophilic binder, said dye is contained in an amount of 0.001 to 0.3 in terms of an absorbance at said maximum absorption wavelength, and at least one of said layers contains a hydrazine compound represented by Formula H:

Formula H

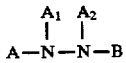

wherein A represents a substituted or unsubstituted alkyl group, an aryl group, a heterocyclic group; B represents an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfamoyl group, a sulfinamoyl group, an alkoxysulfonyl group, a thioacyl group, a thiocarbamoyl group, an acylcarbonyl group, a heterocyclic group; A1 and $A_2$ independently represent a hydrogen atom, an acyl group, a sulfonyl group or an oxalyl group.

3. The silver halide photographic light-sensitive material of claim 2, wherein said hydrazine compound represented by Formula H is represented by Formula Ha:

Formula Ha

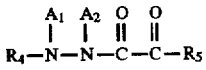

wherein $R_4$ represents an aryl group or a heterocyclic group, $R_5$ represents —N($R_6R_7$) group or —$OR_8$ group, wherein $R_6$ and $R_7$ independently represent a hydrogen atom, an alkyl group, an alkenyl group, an aryl group, a heterocyclic group, an amino group, a hydroxyl group, an alkoxyl group, an alkenyloxy group, an aryloxy group or a heterocyclicoxy group, provided that $R_6$ and $R_7$ may form a ring together with a nitrogen atom; $R_8$ represents a hydrogen atom, an alkyl group, an alkenyl group, an alkynyl group, an aryl group or a heterocyclic group; $A_1$ and $A_2$ are synonymous respectively with said $A_1$ group and said $A_2$ group represented by said Formula H.

4. The silver halide photographic light-sensitive material of claim 2, wherein said dye is incorporated by a process comprising the steps of:

(a) dispersing solid particles of said dye in a hydrophilic medium at a pH value of not more than 7 to form a solid particle dispersion; and, (b) incorporating said dispersion in at least one of said layers.

5. The silver halide photographic light-sensitive material of claim 2, wherein said dye is contained in said light-sensitive layer.

6. The silver halide photographic light-sensitive material of claim 2, wherein said dye is contained in an amount of 0.005 to 0.15 in terms of an absorbance at said maximum absorption wavelength.

7. The silver halide photographic light-sensitive material of claim 2, wherein said material is a silver halide photographic light-sensitive material for an argon laser use having said maximum sensitivity wavelength being within the range of 460 nm to 510 nm.

8. The silver halide photographic light-sensitive material of claim 2, wherein said material is a silver halide photographic light-sensitive material for a helium -neon laser use having said maximum sensitivity wavelength being within the range of 600 nm to 650 nm.

9. The silver halide photographic light-sensitive material of claim 2, wherein said material is a silver halide photographic light-sensitive material for a red diode laser use having said maximum sensitivity wavelength being within the range of 651 nm to 700 nm.

10. The silver halide photographic light-sensitive material of claim 2, wherein said material is a silver halide photographic light-sensitive material for infrared semiconductor laser use having said maximum sensitivity wavelength being within the range of 750 nm to 800 nm.

11. The silver halide photographic light-sensitive material of claim 2, wherein said hydrazine compound represented by Formula H is contained in an amount of $5\times10^{-7}$ to $5\times10^{-1}$ mol per mol of silver halide.

12. The silver halide photographic light-sensitive material of claim 2, wherein said hydrazine compound represented by Formula H is contained in an amount of $5\times10^{-6}$ to $5\times10^{-2}$ mol per mol of silver halide.

13. The silver halide photographic light-sensitive material of claim 2, wherein at least one of said layers comprises a compound represented by Formula Na or Formula Nb:

Formula Na

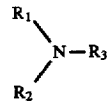

wherein $R_1$, $R_2$ and $R_3$ each represents a hydrogen atom, an alkyl group, an alkenyl group, an alkynyl group, an aryl group, provided that $R_1$, $R_2$ and $R_3$ are not a hydrogen atom at the same time, and may combine to form a ring;

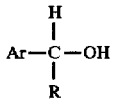

Formula Nb wherein Ar represents an aryl group or a heterocyclic aromatic ring, and R represents an alkyl group, an alkenyl group, an alkynyl group or an aryl group.

14. The silver halide photographic light-sensitive material of claim 2, wherein said silver halide photographic light-sensitive material is a photographic material for argon laser use.

15. The silver halide photographic light-sensitive material of claim 2, wherein said silver halide photographic light-sensitive material is a photographic material for helium-neon laser use.

16. The silver halide photographic light-sensitive material of claim 2, wherein said silver halide photographic light-sensitive material is a photographic material for red laser diode use.

17. The silver halide photographic light-sensitive material of claim 2, wherein said silver halide photographic light-sensitive material is a photographic material for infrared semiconductor laser use.

* * * * *